US012502010B1

(12) United States Patent
Bickel et al.

(10) Patent No.: US 12,502,010 B1
(45) Date of Patent: Dec. 23, 2025

(54) PLAYYARD

(71) Applicant: Regalo International, LLC, Burnsville, MN (US)

(72) Inventors: Shannon R. Bickel, Lakeville, MN (US); Timothy C. Daggy, Shakopee, MN (US)

(73) Assignee: Regalo International, LLC, Burnsville, MN (US)

( * ) Notice: Subject to any disclaimer, the term of this patent is extended or adjusted under 35 U.S.C. 154(b) by 0 days.

(21) Appl. No.: 18/892,450

(22) Filed: Sep. 22, 2024

(51) Int. Cl.
*A47D 13/06* (2006.01)
*A47D 7/00* (2006.01)
*A47D 9/00* (2006.01)

(52) U.S. Cl.
CPC ..... *A47D 13/066* (2013.01); *A47D 7/002* (2013.01); *A47D 9/005* (2013.01); *A47D 13/063* (2013.01); *A47D 13/06* (2013.01)

(58) Field of Classification Search
CPC .. A47D 13/066; A47D 13/063; A47D 13/061; A47D 13/06; A47D 7/00; A47D 7/002; A47D 9/00; A47D 9/005
USPC ..... 5/93.1, 98.1, 99.1
See application file for complete search history.

(56) References Cited

U.S. PATENT DOCUMENTS 2,464,866 A * 3/1949 Holtz ..... A47D 13/063 5/98.1
2,698,443 A * 1/1955 Ralick ..... A47D 7/002 5/98.1
2,784,420 A * 3/1957 Moltane ..... A47D 13/066 5/98.1
3,165,760 A * 1/1965 Abajian ..... A47D 7/002 5/98.1
4,202,065 A * 5/1980 Sullivan ..... A47D 9/005 5/99.1
4,376,318 A * 3/1983 Cirillo ..... A47D 13/063 5/99.1
4,811,437 A * 3/1989 Dillner ..... A47D 13/063 5/99.1
D304,523 S * 11/1989 Dillner ..... 5/99.1
4,985,948 A * 1/1991 Mariol ..... E05D 11/1007 5/99.1
5,163,191 A * 11/1992 Chan ..... A47D 9/016 5/98.1
5,172,435 A * 12/1992 Griffin ..... A47D 9/005 5/98.1
5,560,055 A * 10/1996 Ziegler ..... A47D 13/063 5/99.1
5,581,827 A * 12/1996 Fong ..... A47D 13/063 5/98.1

(Continued)

FOREIGN PATENT DOCUMENTS

GB 2235623 A * 3/1991 ..... E05D 11/1007

*Primary Examiner* — Robert G Santos

(57) ABSTRACT

The present playyard includes relatively short vertical corner posts and relatively long horizontal support members. The preferred ratio of the length of a relatively long horizontal support member, or length of a playyard side, to the height of a relatively short vertical post, or height of a playyard side, is about two to one. The relatively long horizontal support member extends directly from one relatively short vertical corner post to the next relatively short vertical corner post. The relatively short vertical corner post is one-piece. The relatively long horizontal support member is no more and no less than two pieces.

18 Claims, 19 Drawing Sheets

(56) References Cited

U.S. PATENT DOCUMENTS

| | | | | | |
|---|---|---|---|---|---|
| 5,697,111 | A * | 12/1997 | Dillner | A47D 13/063 5/99.1 |
| 5,727,265 | A * | 3/1998 | Ziegler | A47D 13/063 5/99.1 |
| 6,421,850 | B1 * | 7/2002 | Welsh, Jr. | A47D 13/063 5/98.1 |
| 6,675,413 | B2 * | 1/2004 | Hsia | A47D 13/06 5/98.1 |
| 6,901,613 | B1 * | 6/2005 | Hsia | A47D 13/063 5/98.1 |
| 10,194,755 | B1 | 2/2019 | Flannery et al. | |
| 10,448,752 | B1 | 10/2019 | Flannery et al. | |
| 10,674,835 | B1 | 6/2020 | Flannery et al. | |
| 10,932,589 | B1 | 3/2021 | Flannery et al. | |
| 11,026,522 | B1 | 6/2021 | Flannery et al. | |
| 11,359,401 | B1 | 6/2022 | Flannery et al. | |
| 11,596,242 | B1 | 3/2023 | Flannery et al. | |
| 11,707,140 | B1 | 7/2023 | Flannery et al. | |
| 11,903,495 | B1 | 2/2024 | Bickel et al. | |
| 2003/0066129 | A1 * | 4/2003 | Hsia | A47D 13/06 5/99.1 |

* cited by examiner

PLAYYARD

FIELD OF THE INVENTION

The present invention relates to a playyard and particularly to a playyard with relatively short vertical posts and relatively long horizontal support members.

BACKGROUND OF THE INVENTION

"Stuck in the Middle with You" is a song from the 1970s by Stealers Wheel. The song's title has been adopted by a great many playyards. That is, smack in the middle of a horizontally extending member there is an odd connection that extends vertically or obliquely such as to another horizontally extending member. For example, between corner posts there may be an intermediate post that engages horizontally extending members. Such intermediate connections are hard and unforgiving. Such intermediate connections are hardware. Such intermediate connections maximize hardware at the expense of soft components.

SUMMARY OF THE INVENTION

A feature of the present invention is a playyard.

Another feature of the present invention is the provision in a playyard, of a frame having no more and no less than first, second, third, and fourth corner posts such that the playyard includes no more and no less than four corner posts, wherein each of the first, second, third, and fourth corner posts is one-piece.

Another feature of the present invention is the provision in a playyard, of a frame having no more and no less than a pair of first uppermost and lowermost horizontal support members extending between the first and second corner posts.

Another feature of the present invention is the provision in a playyard, of a frame having no more and no less than a pair of second uppermost and lowermost horizontal support members extending between the second and third corner posts.

Another feature of the present invention is the provision in a playyard, of a frame having no more and no less than a pair of third uppermost and lowermost horizontal support members extending between the third and fourth corner posts.

Another feature of the present invention is the provision in a playyard, of a frame having no more and no less than a pair of fourth uppermost and lowermost horizontal support members extending between the fourth and first corner posts.

Another feature of the present invention is the provision in a playyard, of a frame where each of the first, second, third, and fourth uppermost and lowermost horizontal support members have no more and no less than two pieces such that each of said first, second, third, and fourth uppermost and lowermost support members include first and second horizontal pieces, where the first and second horizontal pieces are engaged to each other by a male/female connection at inner ends of the first and second horizontal pieces.

Another feature of the present invention is the provision in a playyard, of a frame where each of the first, second, third, and fourth uppermost and lowermost horizontal support members have outer ends and extend directly from a corner post to a corner post such that the first, second, third, and fourth uppermost and lowermost horizontal support member derive sole hardware support from the outer ends engaging respective corner posts.

Another feature of the present invention is the provision in a playyard, of a frame having no more and no less than first, second, third, fourth, fifth, sixth, seventh, and eighth corner connections, where each of the first, second, third, fourth, fifth, sixth, seventh, and eighth corner connections are one-piece.

Another feature of the present invention is the provision in a playyard, of the first and second corner connections engaging respective upper and lower ends of the first corner post and further engaging, respectively, the first and fourth uppermost horizontal support members and first and fourth lowermost horizontal support members.

Another feature of the present invention is the provision in a playyard, of the third and fourth corner connections engaging respective upper and lower ends of the second corner post and further engaging, respectively, the first and second uppermost horizontal support members and first and second lowermost horizontal support members.

Another feature of the present invention is the provision in a playyard, of the fifth and sixth corner connections engaging respective upper and lower ends of the third corner post and further engaging, respectively, the second and third uppermost horizontal support members and second and third lowermost horizontal support members.

Another feature of the present invention is the provision in a playyard, of the seventh and eighth corner connections engaging respective upper and lower ends of the fourth corner post and further engaging, respectively, the third and fourth uppermost horizontal support members and the third and fourth lowermost horizontal support members.

Another feature of the present invention is the provision in a playyard, of sheeting that includes a first sheeting portion extending to and between the first uppermost and lowermost horizontal support members, where the first sheeting portion has a first uppermost sleeve for the first uppermost horizontal support member and a first lowermost sleeve for the first lowermost horizontal support member, where the first sheeting portion further extends to and between the first and second corner posts, and where the first sheeting portion includes a first sleeve portion engaging the first corner post and a second sleeve portion engaging the second corner post.

Another feature of the present invention is the provision in a playyard, of sheeting that includes a second sheeting portion extending to and between the second uppermost and lowermost horizontal support members, where the second sheeting portion has a second uppermost sleeve for the second uppermost horizontal support member and a second lowermost sleeve for the second lowermost horizontal support member, where the second sheeting portion further extends to and between the second and third corner posts, and where the second sheeting portion includes the second sleeve portion engaging the second corner post and further includes a third sleeve portion engaging the third corner post.

Another feature of the present invention is the provision in a playyard, of sheeting that includes a third sheeting portion extending to and between the third uppermost and lowermost horizontal support members, where the third sheeting portion has a third uppermost sleeve for the third uppermost horizontal support member and a third lowermost sleeve for the third lowermost horizontal support member, where the third sheeting portion further extends to and between the third and fourth corner posts, and where the third sheeting portion includes the third sleeve portion engaging the third corner post and further includes a fourth sleeve portion engaging the fourth corner post.

Another feature of the present invention is the provision in a playyard, of sheeting that includes a fourth sheeting portion extending to and between the fourth uppermost and lowermost horizontal support members, where the fourth sheeting portion has a fourth uppermost sleeve for the fourth uppermost horizontal support member and a fourth lowermost sleeve for the fourth lowermost horizontal support member, where the fourth sheeting portion further extends to and between the fourth and first corner posts, and where the fourth sheeting portion includes the fourth sleeve portion engaging the fourth corner post and the first sleeve portion engaging the first corner post.

Another feature of the present invention is the provision in a playyard, of the first uppermost horizontal support member engaging the first and third corner connections and in combination therewith defining a first sidewall length, where the first lowermost horizontal support member engages the second and fourth corner connections and in combination therewith defines the first sidewall length, and where the first post engages the first and second corner connections and in combination therewith defines a first corner height.

Another feature of the present invention is the provision in a playyard, of the second uppermost horizontal support member engaging the third and fifth corner connections and in combination therewith defining a second sidewall length, where the second lowermost horizontal support member engages the fourth and sixth corner connections and in combination therewith defines the second sidewall length, and where the second post engages the third and fourth corner connections and in combination therewith defines a second corner height.

Another feature of the present invention is the provision in a playyard, of the third uppermost horizontal support member engaging the fifth and seventh corner connections and in combination therewith defining a third sidewall length, where the third lowermost horizontal support member engages the sixth and eighth corner connections and in combination therewith defines the third sidewall length, and where the third post engages the fifth and sixth corner connections and in combination therewith defines a third corner height.

Another feature of the present invention is the provision in a playyard, of the fourth uppermost horizontal support member engaging the seventh and first corner connections and in combination therewith defining a fourth sidewall length, where the fourth lowermost horizontal support member engages the eighth and second corner connections and in combination therewith defines the fourth sidewall length, and where the fourth post engages the seventh and eighth corner connections and in combination therewith defines a fourth corner height.

Another feature of the present invention is the provision in a playyard, of a ratio of the first sidewall length to the first corner height being about two to one, of a ratio of the second sidewall length to the second corner height being about two to one, of a ratio of the third sidewall length to the third corner height being about two to one, and of a ratio of the fourth sidewall length to the fourth corner height being about two to one.

Another feature of the present invention is the provision in a playyard, of a fifth sheeting portion, where the fifth sheeting portion extends to and between the first and third lowermost sleeves and where the fifth sheeting portion further extends to and between the second and fourth lowermost sleeves such that the fifth sheeting portion provides a floor for the playyard.

Another feature of the present invention is the provision in a playyard, of each of the second, fourth, sixth, and eighth corner connections including a lowermost portion, where the lowermost portions define a first plane and the floor is above the first plane.

Another feature of the present invention is the provision in a playyard, of each of the first, second, third, and fourth uppermost sleeves extends inwardly relative to the frame, wherein each of the first, second, third, and fourth uppermost sleeves extends inwardly relative to the frame, and wherein each of the first, second, third, and fourth corner post sleeves extends inwardly relative to the frame.

Another feature of the present invention is the provision in a playyard, of the playyard including an open top, where the open top is defined by the first, second, third, and fourth uppermost horizontal support members.

Another feature of the present invention is the provision in a playyard, of the playyard including an open bottom, where the open bottom is defined by the first, second, third, and fourth lowermost horizontal support members.

Another feature of the present invention is the provision in a playyard, of the playyard including an open top and an open bottom, where the open top is defined by the first, second, third, and fourth uppermost horizontal support members, where the open bottom is defined by the first, second, third, and fourth lowermost horizontal support members.

Another feature of the present invention is the provision in a playyard, of the male/female connection including a spring biased pin engaging each of the first and second horizontal pieces.

Another feature of the present invention is the provision in a playyard, of each of the first, second, third, fourth, fifth, sixth, seventh, and eighth corner connections including first and second sockets for engaging horizontal support members, where each of the first, second, third, fourth, fifth, sixth, seventh, and eight corner connections includes a third socket for engaging a corner post, where the first, second, and third sockets have respective first, second, and third axes, where the first and second axes extend at a right angle to each other, where the first and third axes extend at a right angle to each other, and where the second and third axis extend at a right angle to each other.

Another feature of the present invention is the provision in a playyard, of each of the first, second, third, fourth, fifth, sixth, seventh, and eighth corner connections including a first brace coplanar with the first axis, of a second brace coplanar with the second axis, and of a third brace coplanar with the third axis.

Another feature of the present invention is the provision in a playyard, of the first, second, third, and fourth uppermost and lowermost horizontal support members defining respective first, second, third, and fourth frame planes, wherein the first sheeting portion includes a first sheet section between the first uppermost and lowermost sleeves, wherein the second sheeting portion includes a second sheet section between the second uppermost and lowermost sleeves, wherein the third sheeting portion includes a third sheet section between the third uppermost and lowermost sleeves, wherein the fourth sheeting portion includes a fourth sheet section between the fourth uppermost and lowermost sleeves, wherein the first, second, third, and fourth sheet sections define first, second, third, and fourth sheet section planes, and wherein the first, second, third, and fourth sheet section planes are, respectively, disposed inwardly of, adjacent to, and obliquely of the first, second, third, and fourth frame planes.

Another feature of the present invention is the provision in a playyard, of the fifth sheeting portion being taut such that an inward pressure is exerted on the first, second, third, and fourth lowermost sleeves, where the inward pressure pulls on the first, second, third, and fourth lowermost horizontal support members.

Another feature of the present invention is the provision in a playyard, of a perimeter of the fifth sheeting portion being less than a perimeter defined by a combination of i) the first, second, third, and fourth lowermost horizontal support members and ii) the second, fourth, sixth, and eighth corner connections, wherein the fifth sheeting portion includes first, second, third, and fourth outermost edges defining the perimeter of the fifth sheeting portion, wherein the first, second, third, and fourth lowermost sleeves engaging, respectively, the first, second, third, and fourth outermost edges, wherein the first uppermost and lowermost horizontal support members define a first plane, wherein the second uppermost and lowermost horizontal support members define a second plane, wherein the third uppermost and lowermost horizontal support members define a third plane, and wherein the fourth uppermost and lowermost horizontal support members define a fourth plane, and wherein the first, second, third, and fourth outermost edges of the floor of the sheeting are spaced, respectively, from the first, second, third, and fourth planes.

Another feature of the present invention is the provision in a playyard, of first, second, third, and fourth flexible flaps disposed, respectively, over the first, third, fifth, and seventh corner connections, where the first flexible flap engages inner and outer faces of the first and fourth sheeting portions, where the second flexible flap engages inner and outer faces of the first and second sheeting portions, where the third flexible flap engages inner and outer faces of the second and third sheeting portions, and where the fourth flexible flap engages inner and outer faces of the third and fourth sheeting portions.

Another feature of the present invention is the provision in a playyard, of the first uppermost horizontal support member being engagable to and disengagable from the first and third corner connections, of the first lowermost horizontal support member being engagable to and disengagable from the second and fourth corner connections, of the second uppermost horizontal support member being engagable to and disengagable from the third and fifth corner connections, of the second lowermost horizontal support member being engagable to and disengagable from the fourth and sixth corner connections, of the third uppermost horizontal support member being engagable to and disengagable from the fifth and seventh corner connections, of the third lowermost horizontal support member being engagable to and disengagable from the sixth and eighth corner connections, of the fourth uppermost horizontal support member being engagable to and disengagable from the seventh and first corner connections, and of the fourth lowermost horizontal support member being engagable to and disengagable from the eighth and second corner connections, of the first corner post being engagable to and disengagable from first and second corner connections, of the second corner post being engagable to and disengagable from the third and fourth corner connections, of the third corner post being engagable to and disengagable from fifth and sixth corner connections, of the fourth corner post being engagable to and disengagable from the seventh and eighth corner connections, and of the first and second horizontal pieces being engagable to and disengagable from each other such that the frame of the playyard may be set up and broken down without destroying a structural integrity of any of the support members, corner connections, corner posts, and horizontal pieces of the frame.

Another feature of the present invention includes the provision in a playyard, of the first sheet section including a mesh portion, wherein the second sheet section includes a mesh portion, wherein the third sheet section includes a mesh portion, and wherein the fourth sheet section includes a mesh portion.

Another feature of the present invention includes the provision in a playyard, of the first sheet section including a mesh portion adjacent to upper and lower opaque bands, wherein the second sheet section includes a mesh portion adjacent to upper and lower opaque bands, wherein the third sheet section includes a mesh portion adjacent to upper and lower opaque bands, and wherein the fourth sheet section includes a mesh portion adjacent to upper and lower opaque bands.

Advantages of the present invention include that a) at the same time, soft components are maximized and hard components are minimized, and b) the sides of the playyard are long and soft. Features contributing to these advantages are the long reach of the horizontal support members, the corner posts providing the sole hardware support for the horizontal support members, no intermediate posts between the corner posts, and the relatively long overlap between the male/female connections in the horizontal support members.

Another advantage of the present invention is that the playyard is strong. One feature contributing to this advantage is the structure of the sheeting. The sheeting is manufactured to be tight such that all sleeves pull inwardly on their respective vertical and horizontal components (four corner posts and eight horizontal support members) at the same time. The sheeting is manufactured to be disposed inwardly of the planes defined by horizontal support members such that the fifth sheeting portion or floor pulls inwardly directly upon the lowermost sleeves that in turn pull on lowermost horizontal support members. The fifth sheeting portion or floor pulls directly on the corner post sleeves that in turn pull on the corner posts. The fifth sheeting portion or floor pulls indirectly on the uppermost sleeves that pull on the upper horizontal members.

Another advantage of the present invention is that the playyard is easy to assemble and disassemble. Little physical effort is required.

Another advantage of the present invention is that it is simple to assemble and disassemble. Where parts go and what part connects to what part take little thought.

Another advantage of the present invention is that it is inexpensive. One feature contributing to this advantage is that relatively expensive metal hardware parts, such as the horizontal support members and corner posts, are minimized.

DESCRIPTION

Figure 1:
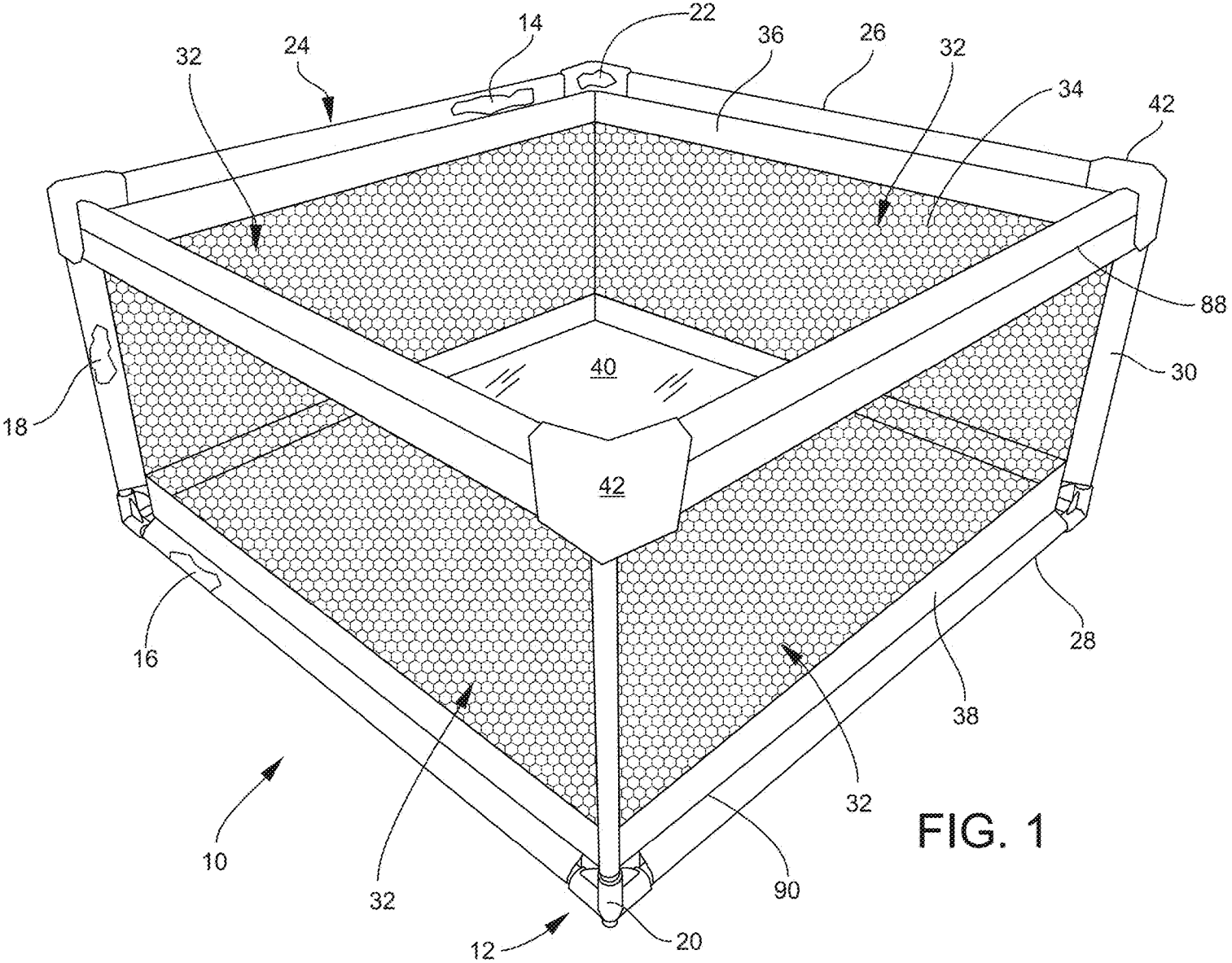
FIG. 1 is a perspective view of the present assembled playyard.

As shown in FIG. 1, the present playyard is indicated by the reference number 10. Playyard 10 includes a frame 12 having a) first, second, third, and fourth uppermost horizontal support members 14, b) first, second, third, and fourth lowermost horizontal support members 16, c) first, second, third, and fourth corner posts 18, d) first, second, third, and fourth lower corner connections 20, and e) first, second, third, and fourth upper corner connections 22.

Playyard 10 further includes sheeting 24 having first, second, third, and fourth sheeting portions 32, where the sheeting portions 32 include a) respective first, second, third, and fourth uppermost sleeves 26 engaging, respectively, the first, second, third, and fourth uppermost horizontal support members 14, and b) respective first, second, third, and fourth lowermost sleeves 28 engaging, respectively, the first, second, third, and fourth lowermost horizontal support members 16. The first sheeting portion 32 further includes a first and second corner post sleeves 30, the second sheeting portion 32 further includes the second corner post sleeve 30 and a third corner post sleeve 30, the third sheeting portion 32 further includes the third corner post sleeve 30 and a fourth corner post sleeve 30, and the fourth sheeting portion 32 further includes the fourth corner post sleeve 30 and the first corner post sleeve 30.

Each of the sheeting portions 32 further includes a) first, second, third, and fourth mesh sections 34, b) first, second, third, and fourth uppermost flexible fabric bands 36 extending between the first, second, third, and fourth mesh sections 34 and, respectively, the first, second, third, and fourth uppermost sleeves 36, and c) first, second, third, and fourth lowermost flexible fabric bands 38 extending between the first, second, third, and fourth mesh sections 34 and, respectively, the first, second, third, and fourth lowermost sleeves 28. Mesh sections 34 are see-through. Uppermost and lowermost flexible fabric bands 36, 38 are one or more of a) not see-through, b) opaque, c) not transparent, d) not translucent.

Figure 16B:
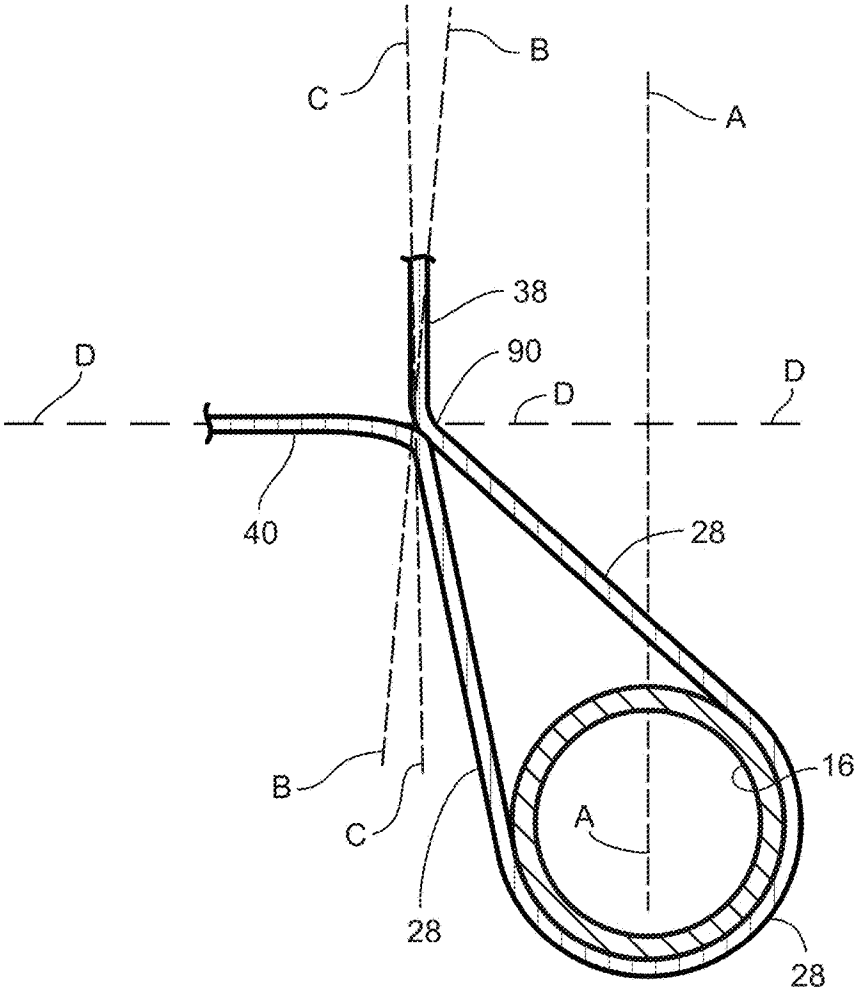
FIG. 16B is a section view of a lowermost sleeve engaged to a lowermost horizontal support member of the frame of FIG. 1, where the section view is taken vertically, where the lowermost sleeve transitions into the sidewall of the sheeting and further transitions into the floor of the sheeting, where the sidewall and floor of the sheeting are disposed obliquely relative to each other, where the floor defines a first plane parallel to and adjacent to a second plane defined by the lowermost horizontal support members, and where the sidewall defines a plane that is oblique relative to a plane defined by a pair of uppermost and lowermost horizontal support members.

Sheeting 24 further includes a fifth sheeting portion or floor 40. Floor 40 is engaged to lowermost edges of the first, second, third, and fourth lowermost flexible fabric bands 36 and the innermost edges of the first, second, third, and fourth lowermost sleeves 28. Floor 40 engages lowermost flexible fabric bands 36 and lowermost sleeves 28 as shown in FIG. 16B.

Sheeting 24 further includes first, second, third, and fourth flexible fabric flaps 42 that extend from an inside face of playyard 10 to an outside face of playyard 10 to extend over, respectively, first, second, third, and fourth upper corner connections 22. The flaps 42 protect a caretaker or child from a hardness of the upper corner connections 22.

Figure 2F:
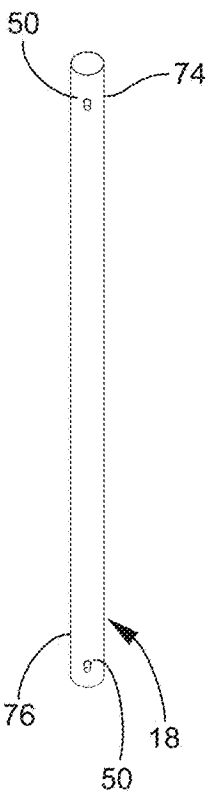
FIG. 2F is a perspective view of a corner post of the playyard of FIG. 1.
Figure 2D:
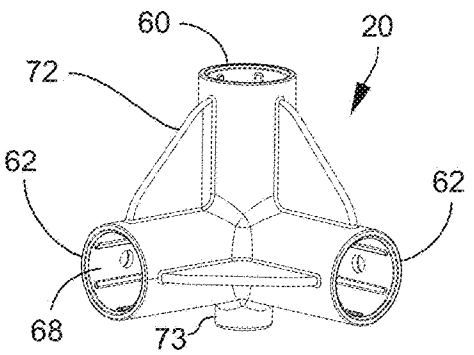
FIG. 2D is a perspective view of a lower corner connection of the playyard of FIG. 1.
Figure 2E:
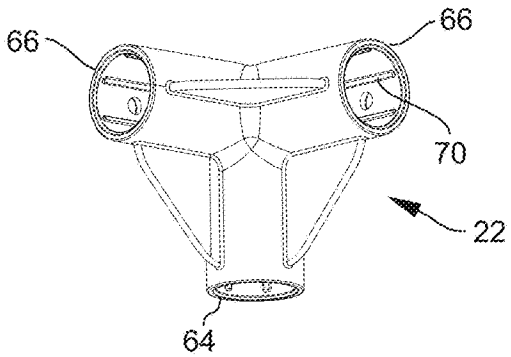
FIG. 2E is a perspective view of an upper corner connection of the playyard of FIG. 1.
Figure 2A:
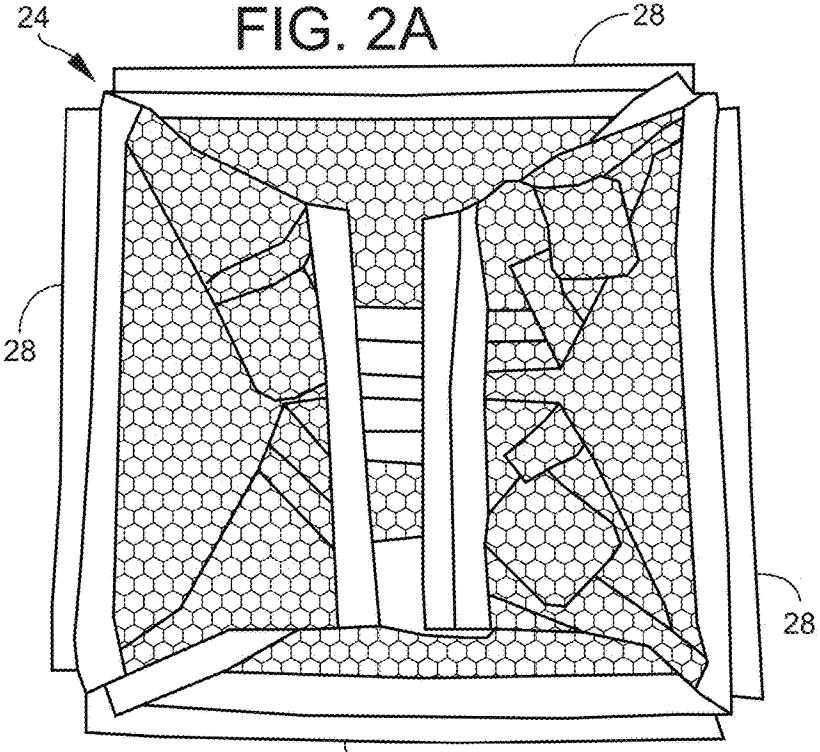
FIG. 2A is a top view of the sheeting for the playyard of claim 1, where lowermost sleeves are left unengaged and ready for insertion therein of lowermost horizontal support members.

FIG. 2A shows sheeting 24 in a collapsed form where the form is generally flat. FIG. 2A shows lowermost sleeves 28 ready for the insertion therein of the lowermost horizontal support members 16.

Figure 2B:
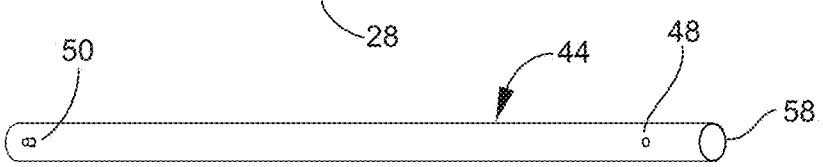
FIG. 2B is a perspective view of a male horizontal piece of a horizontal support member of the playyard of FIG. 1.
Figure 2C:
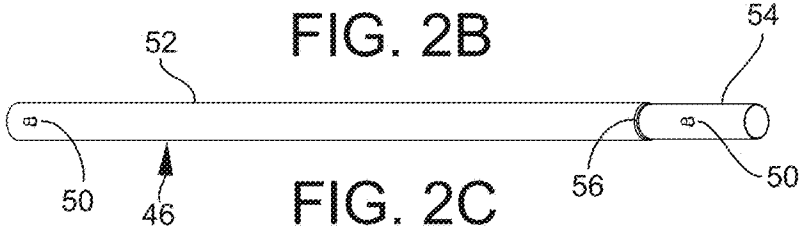
FIG. 2C is a perspective view of a female horizontal piece of a horizontal support member of the playyard of FIG. 1.

FIG. 2B shows a female tubular piece 44 and FIG. 2C shows a male tubular piece 46. When engaged to each other female tubular piece 44 and male tubular piece 46 make up any of the uppermost and lowermost horizontal support members 14, 16. Female tubular piece 44 includes a pin hole 48 or pin opening 48 for a spring biased pin 50 on the male tubular piece 46. Spring biased pin 50 includes a pin shaft portion that extends through an opening in male piece 46 and a base spring portion that lies within the male piece 46. Male piece 46 includes a greater diametrical portion 52 and a lesser diametrical portion 54 separated by an annular stop 56. Lesser diametrical portion 54 is slidingly insertable into an end opening 58 of the female piece 44 until pin 50 snaps into and through pin hole 48 whereupon the male piece 46 is releasably locked to the female piece 44. The male piece 46 may be unlocked from the female piece 44 by pressing upon the spring biased pin 50. Then the male piece 46 is further disengaged from the female piece 44 by sliding the male piece 46 axially out of the female piece 44. The inner diameter of the female piece 44 is slightly greater than or about the same as the outer diameter of the tubular male portion 54 to provide a friction fit between the female piece 44 and male piece 46. The length of male portion 54 is relatively great to provide a relatively great amount of overlap between the female piece 44 and the male piece 46 so as to maximize a straight alignment between the axis of the female piece 44 and the male piece 46 when the pieces 44, 46 are engaged and when transverse pressure in the same direction is applied to opposite ends of the upper and lower horizontal support members 14, 16. Female piece 44 is tubular and cylindrical. Male portion 52 is tubular and cylindrical. Male portion 54 is tubular and cylindrical. The outer diameter of female piece 44 and the outer diameter of the greater diametrical portion 52 of the male piece 46 are the same.

FIGS. 2B and 2C further show the spring biased pins 50 disposed on ends of the pieces 44, 46. On the end opposite the end having pin hole 48, female piece 44 includes a spring biased pin 50 for engaging one of the horizontal sockets 62, 66 of the lower and upper corner connections 20, 22. On the end opposite the end having lesser diametrical portion 54, male piece 46 includes a spring biased pin 50 for engaging one of the horizontal sockets 62, 66 of the lower and upper corner connections 20, 22.

FIGS. 2D and 2E show, respectively, the lower corner connection 20 and the upper corner connection 22. The lower connection 20 has a post socket or receptacle 60 for the lower end of a corner post 18 and a pair of horizontal support member sockets or receptacles 62 for the outer ends of lowermost horizontal support members 16. Socket 60 has an axis that is disposed at a right angle to each of the axes of the sockets 62. Each of the sockets 62 has an axis that is disposed at a right angle to the axis of the other socket 62.

The upper connection 22 has a post socket or receptacle 64 for the upper end of a corner post 18 and a pair of horizontal support member sockets or receptacles 66 for the outer ends of uppermost horizontal support members 14.

Socket 64 has an axis that is disposed at a right angle to each of the axes of the sockets 66. Each of the sockets 66 has an axis that is disposed at a right angle to the axis of the other socket 66.

Each of the sockets 60, 62, 64, 66 has a pin hole for a spring biased pin of the corner post or support member that is engaged therein. Each of the sockets 60, 62, 64, 66 is cylindrical and include axially extending and spaced apart straight interior ridges 70 to provide a friction fit of the corner post or support member while, at the same time, minimizing surface area connection for a ready engagement and disengagement of the corner posts and support members to and from the upper and lower connections 20, 22. Such friction fit is between the inner edge of the ridge 70 and the outside face of the corner post or support member.

Each of the upper and lower connections 20, 22 includes a set of three generally triangular shaped braces 72. Each of the braces 72 lies in a plane defined by the axes of two of the sockets 60, 62, 64, 66. Each of the braces 72 extends from a location adjacent to an opening of a socket 60, 62, 64, 66 to a location adjacent to an opening of another socket 60, 62, 64, 66. Each of the braces 72 engages a cylindrical body of one of the sockets 60, 62, 64, 66 to a cylindrical body of one of the other sockets 60, 62, 64, 66.

FIG. 2D shows that the lower corner connection 20 includes a foot 73. Foot 73 is cylindrically shaped with a flat lowermost end. Foot 73 includes an axis that is coaxial with cavity 60 and corner post 18. Foot 73 is one-piece with lower connection 20.

FIG. 2F shows the tubular corner post 18. Playyard 10 includes first, second, third, and fourth corner posts 18. The four corner posts 18 anchor the four corners of the playyard 10. Corner post 18 is a metal tube having an upper open end 74 and a lower open end 76. Upper end 74 includes a spring biased pin 50 and a lower open end 76 that includes a spring biased pin 50 that locks and unlocks with the pin holes 68 of the sockets 60, 64. The length of the corner post 18 is about one-half of the length of each of the uppermost and lowermost horizontal support members 14, 16 such that the length of each of the uppermost and lowermost horizontal support members 14, 16 is about twice the height of the corner post 18 such that the expanse from corner post 18 to corner post 18 is relatively great so as to minimize hardware or hard components of the playyard 10 and maximize soft components of the playyard 10.

Figure 3A:
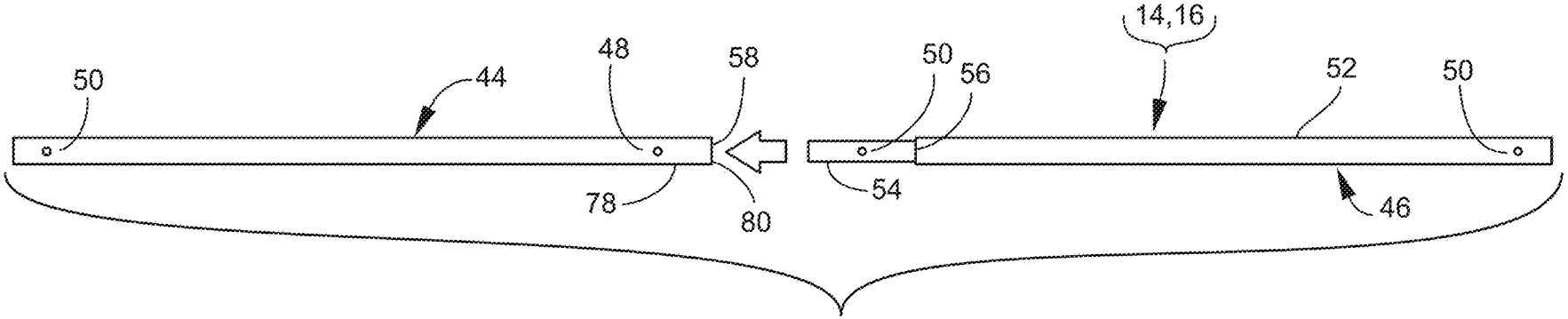
FIG. 3A is an elevation view of the male horizontal piece of FIG. 2B and the female horizontal piece of FIG. 2C shown adjacent to each other and about to be engaged to each other.
Figure 3C:
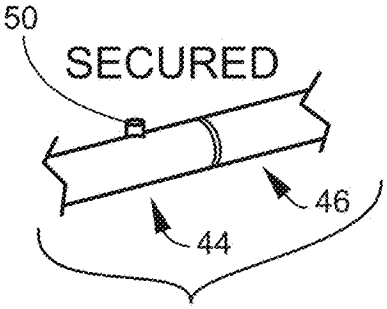
FIG. 3C shows an end portion of the male horizontal piece of FIG. 2B engaged to an end portion of the female horizontal piece of FIG. 2C.
Figure 3B:
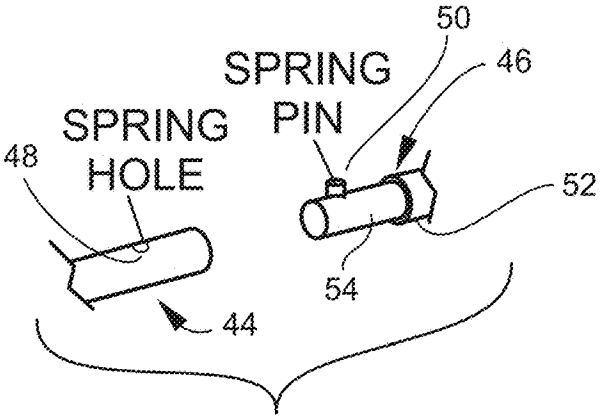
FIG. 3B is a perspective view of an end portion of the male horizontal piece of FIG. 2B and an end portion of the female horizontal piece of FIG. 2C shown adjacent to each other and about to be engaged to each other.

FIGS. 3A, 3B, and 3C show the two types of engagement between the female piece 44 and male piece 46. A first type of engagement is the male/female engagement between open end portion 78 of the female piece 44 and lesser diametrical portion 54 of the male piece 46. This is a friction fit with ready engagement and ready disengagement of the pieces 44, 46 to and from each other. This friction fit occurs along the axial length of lesser diametrical portion 54 to annular stop 56 and along the axial length of female piece 44 from an annular stop edge 80 to beyond the pin hole 48. Supplementing such first type of engagement is the second type of engagement where spring biased pin 50 of male piece 46 locks into spring biased pin hole 48. The thumb or a finger of the user pushes down spring biased pin 50 to be generally flush with the diameter of lesser diametrical portion 54, then the user inserts the lesser diametrical portion 54 into the end opening 58 of the female piece 44, then the user pushes the female piece 44 and male piece 46 together until the spring biased pin pops into the pin hole 48, whereupon the female and male pieces 44, 46 are releasably locked together. To unlock the female and male pieces 44, 46 from each other, the button or pin 50 is pressed down and the female and male pieces 44, 46 are slid apart from each other.

Figure 4:
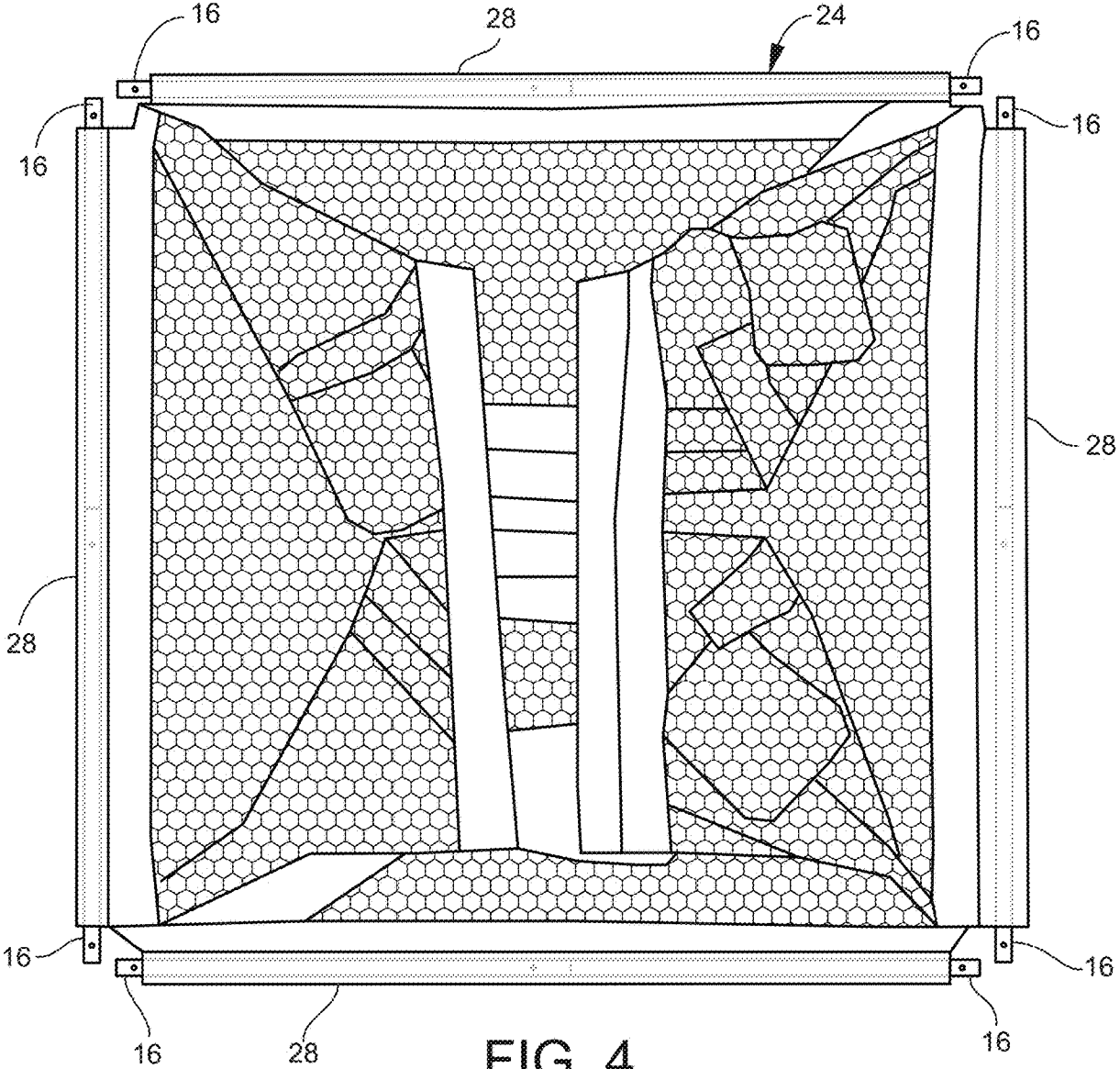
FIG. 4 shows a top schematic view of the sheeting of the playyard of FIG. 1 with the lowermost horizontal support members engaged in the lowermost horizontal sleeves, with end portions of the lowermost horizontal support members extending from sleeve openings of the lowermost horizontal sleeves, with such end portions ready for engagement with lower corner connections.

FIG. 4 may be compared to FIG. 2A. In FIG. 2A, the lowermost sleeves 28 are empty or void and are in a flat form. In FIG. 2A there is no lowermost horizontal support member 16 in any of the lowermost sleeves 28. In FIG. 4, each of the lowermost sleeves 28 includes a lowermost horizontal support member 16 that has been slid therein. Sheeting 24 remains in the flat form in FIG. 4 with the exception of lowermost sleeves 28. In FIG. 4, each of the outer ends of each of the lowermost horizontal support members 16 is adjacent to and spaced from an outer end of another lowermost horizontal support member 16.

Figure 5B:
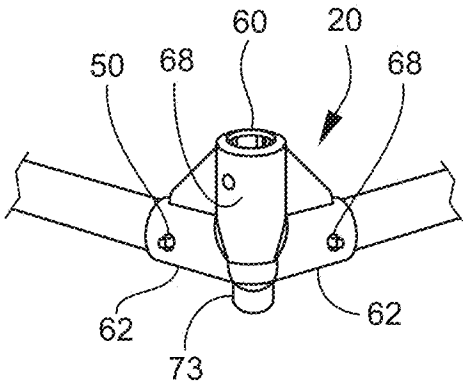
FIG. 5B is a detail perspective view of a lower corner connection of FIG. 2D engaging adjacent ends of two lowermost horizontal support members of FIG. 3A.
Figure 5A:
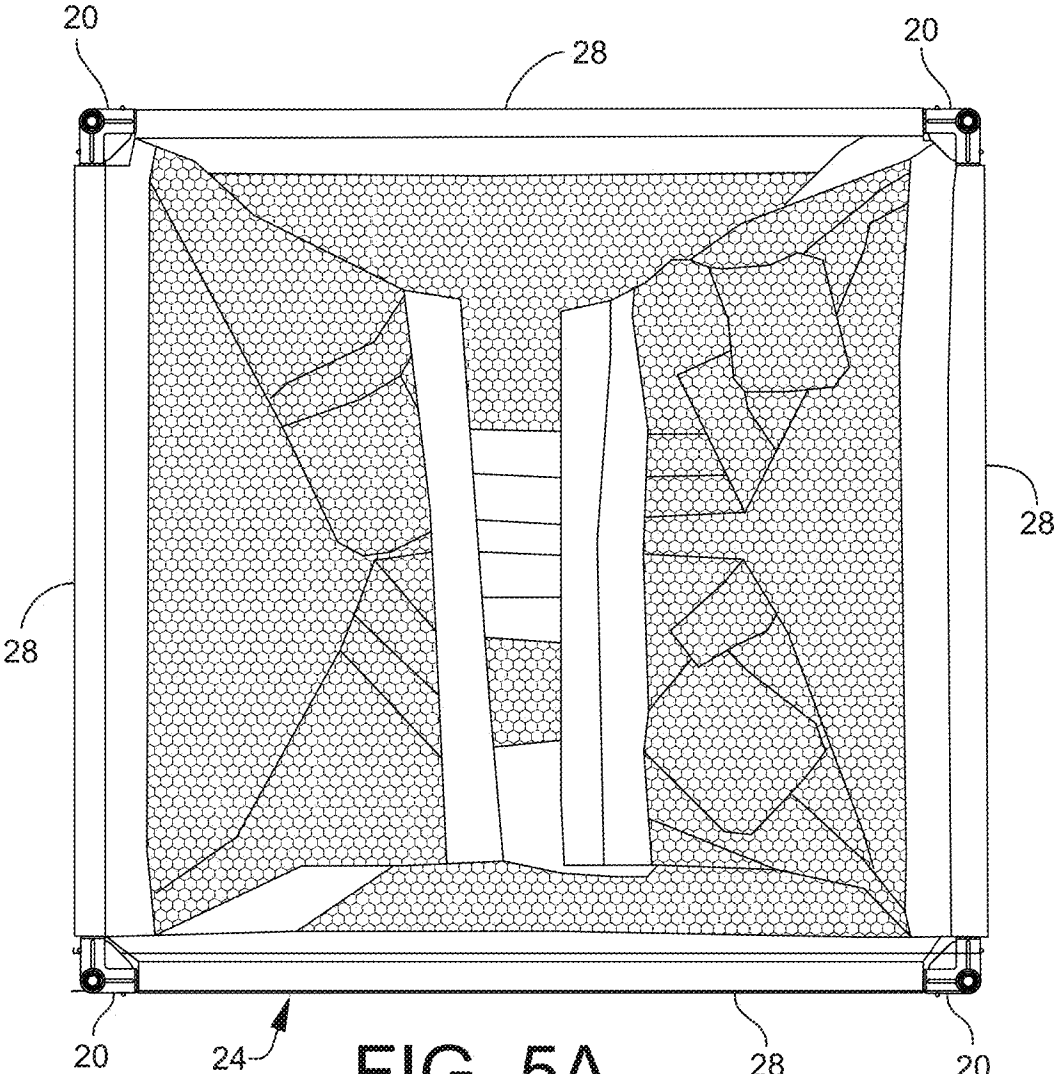
FIG. 5A show a top view of the sheeting of the FIG. 4 with lower corner connections engaging adjacent ends of lowermost horizontal support members, with the lower corner connections ready for engagement with the corner posts.

FIG. 5A may be compared to FIG. 4. In FIG. 4, each of the lowermost sleeves 28 has therein one of the lowermost horizontal support members 16. In FIG. 5A, the first, second, third, and fourth lowermost corner connections 20 have been engaged to the outer ends of the lowermost horizontal support members 16. The outer ends of the lowermost horizontal support members 16 have been slid into and releasably locked into the sockets 62, where the releasable lock is provided by the spring biased pins 50 of the outer ends of the lowermost horizontal support members 16 as shown in FIGS. 2B, 2C, and 3A.

Whereas FIG. 2D shows the inner face of lower corner connection 20, FIG. 5B shows the outer face of the lower corner connection 20. It can be noted that pin holes 68 are disposed on the outer faces of socket 62 and socket 60. It can be further noted that the pin hole 68 on socket 60 has an axis that is coplanar with a plane defined by the pair of upper and lowermost horizontal support members 14, 16, that extends from the side of the socket 60 opposite to that where such pin hole 68 is formed. Such pin hole 68 is offset from a diagonal vertical plane that intersects the lower corner connections 20 that are positioned diagonally across or kitty corner from each other in the playyard 10.

Figure 6A:
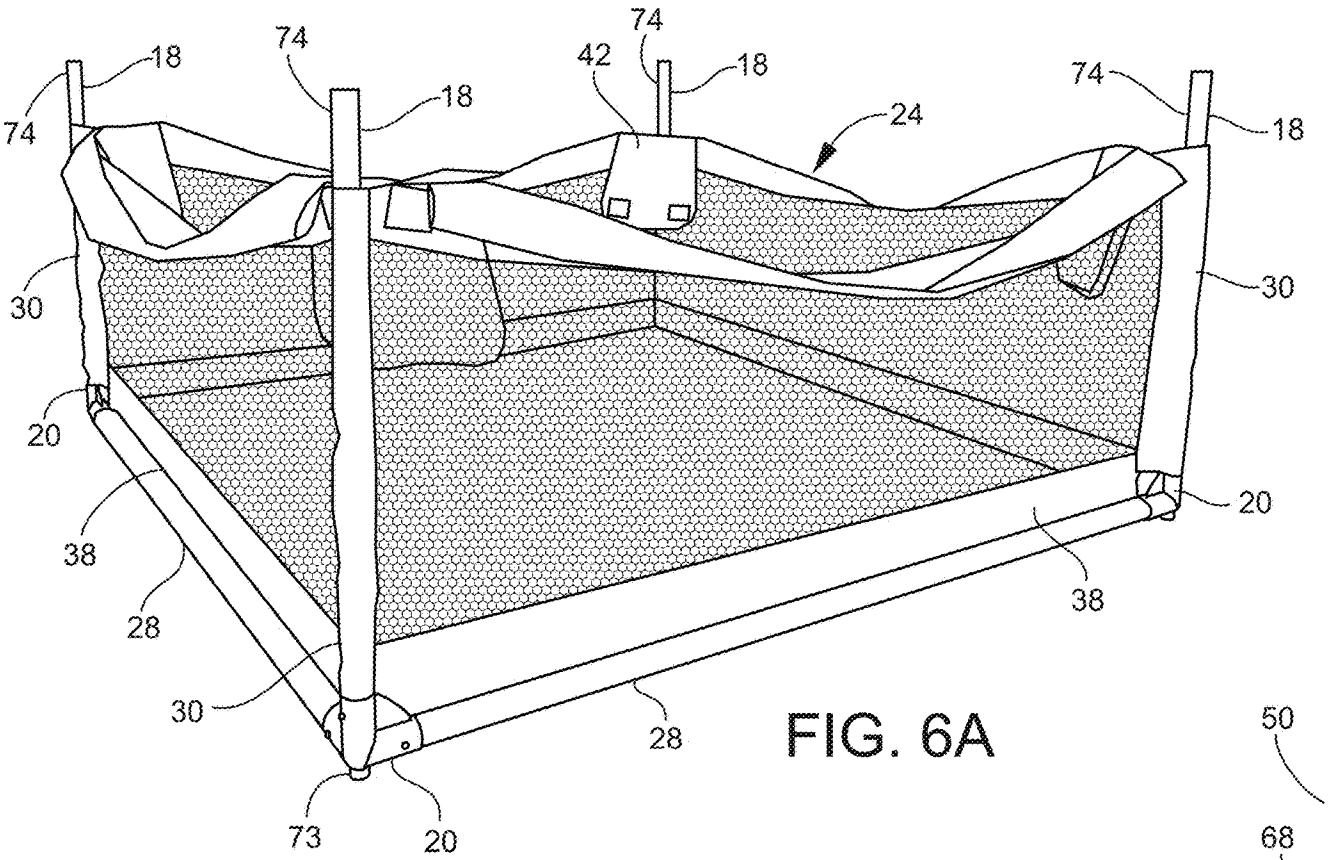
FIG. 6A is a perspective view of the playyard of FIG. 1 being assembled, where first the corner posts are inserted into respective corner post sleeves, where then lower ends of the corner posts are engaged with the lower corner connections, and where then the sheeting as a whole is drawn up the four corner posts, leaving exposed upper ends of the corner posts ready for engagement with upper corner connections.

FIG. 6A may be compared to FIG. 5A. In FIG. 5A, the first, second, third, and fourth lower corner connections 20 have been engaged to the lowermost horizontal support members 16. In FIG. 6A, the vertical corner posts 18 have been engaged to the first, second, third, and fourth lower corner connections 20 and have further been slid into the first, second, third, and fourth corner post sleeves 30.

Figure 6B:
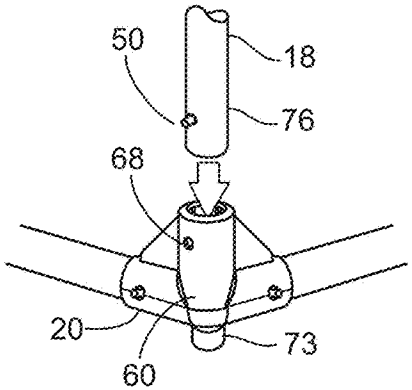
FIG. 6B is a detail perspective view of a corner post of FIG. 2F being inserted in a lower corner connection of FIG. 2D.

In FIG. 6B, it can be seen that the lower end 76 is slid into and releasably locked with socket 60 of the lower corner connection 20. There are two types of engagement here: a male/female engagement between socket 60 and lower end 76 and a pin and pin hole engagement between pin 50 and pin hole 68. Such a two type of an engagement provides sufficient support for the corner post 18 prior to when the uppermost horizontal support members 14 are engaged to the corner posts 18 by the upper corner connections 22.

Figure 7A:
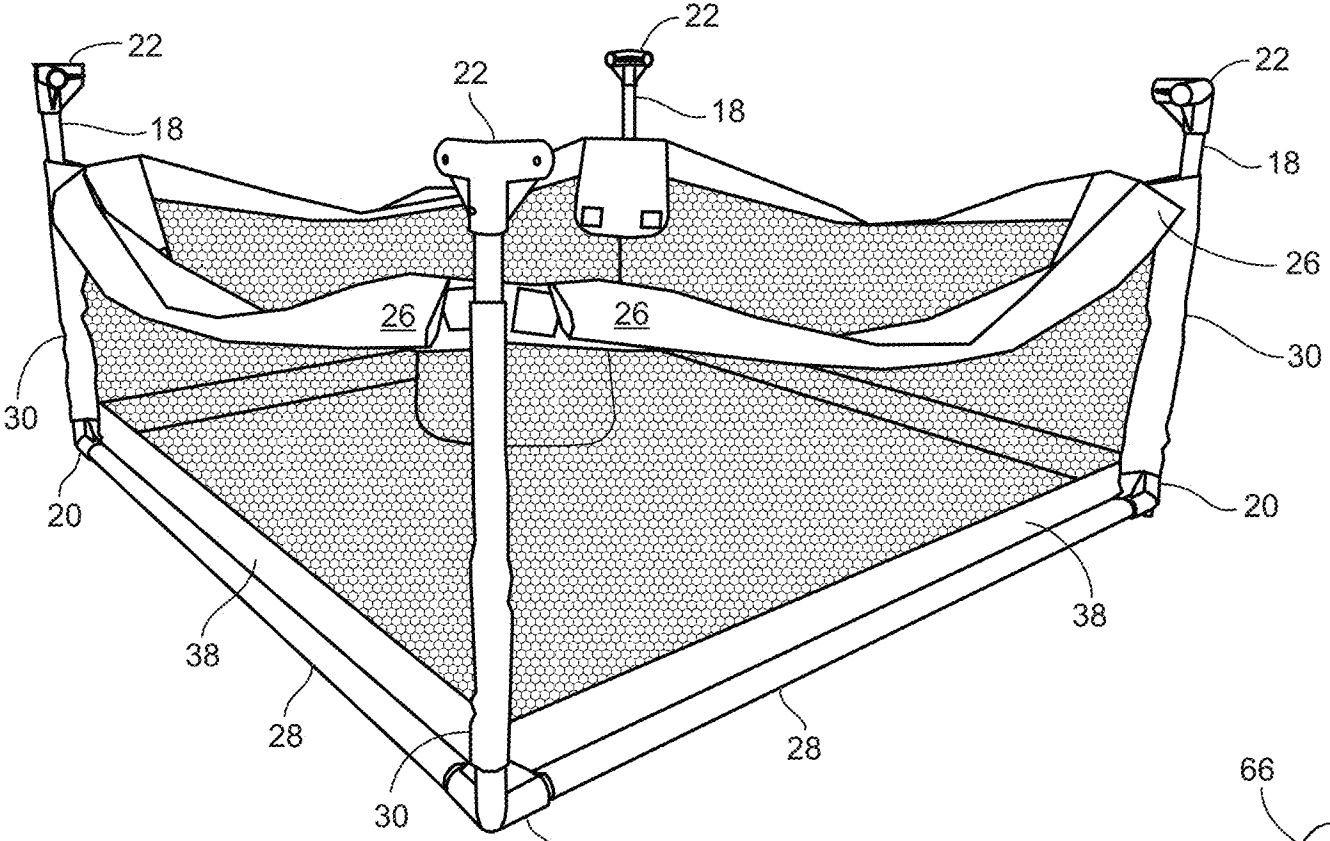
FIG. 7A is a perspective view of the playyard of FIG. 1 being assembled, with the upper corner connections having been engaged to the upper ends of the corner posts, leaving uppermost sleeves ready to be engaged by uppermost horizontal support members.

FIG. 7A can be compared to FIG. 6A. In FIG. 6A, the upper ends 74 of the corner posts 18 are free. In FIG. 7A, the upper corner connections 22 have been engaged to the upper ends 74 of the corner posts 18.

Figure 7B:
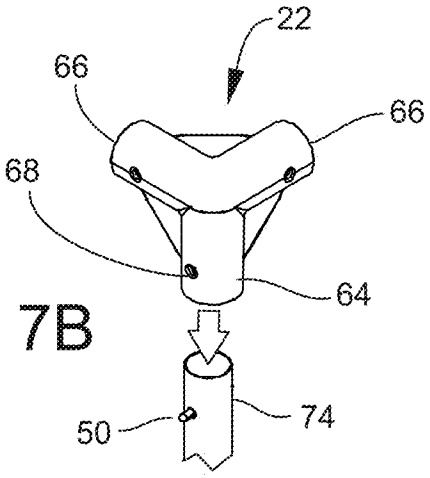
FIG. 7B is a perspective view of the upper corner connection of FIG. 2E being engaged to the upper end of the corner post of FIG. 2F.

FIG. 7B shows that the pin 50 of the upper end 74 extends in a plane that is coplanar with a plane defined by the uppermost and lowermost horizontal support members 14, 16 that extend from the side of corner post 18 that is opposite from which pin 50 extends.

Once the pins 50 of the upper ends 74 are releasably locked with the pin holes 68 of the upper corner connections 22, the sockets 66 are axially aligned with an opposing socket 66 on another upper corner connection 22 and ready to releasably engage an uppermost horizontal support member 14.

In FIG. 7B, it can be seen that the upper end 74 is slid into and releasably locked with socket 64 of the upper corner connection 22. There are two types of engagement here: a male/female engagement between socket 64 and upper end 74 and a pin and pin hole engagement between pin 50 and pin hole 68.

FIG. 7A shows that the uppermost sleeves 26 are relaxed and ready to accept the uppermost horizontal support members 14.

Figure 8A:
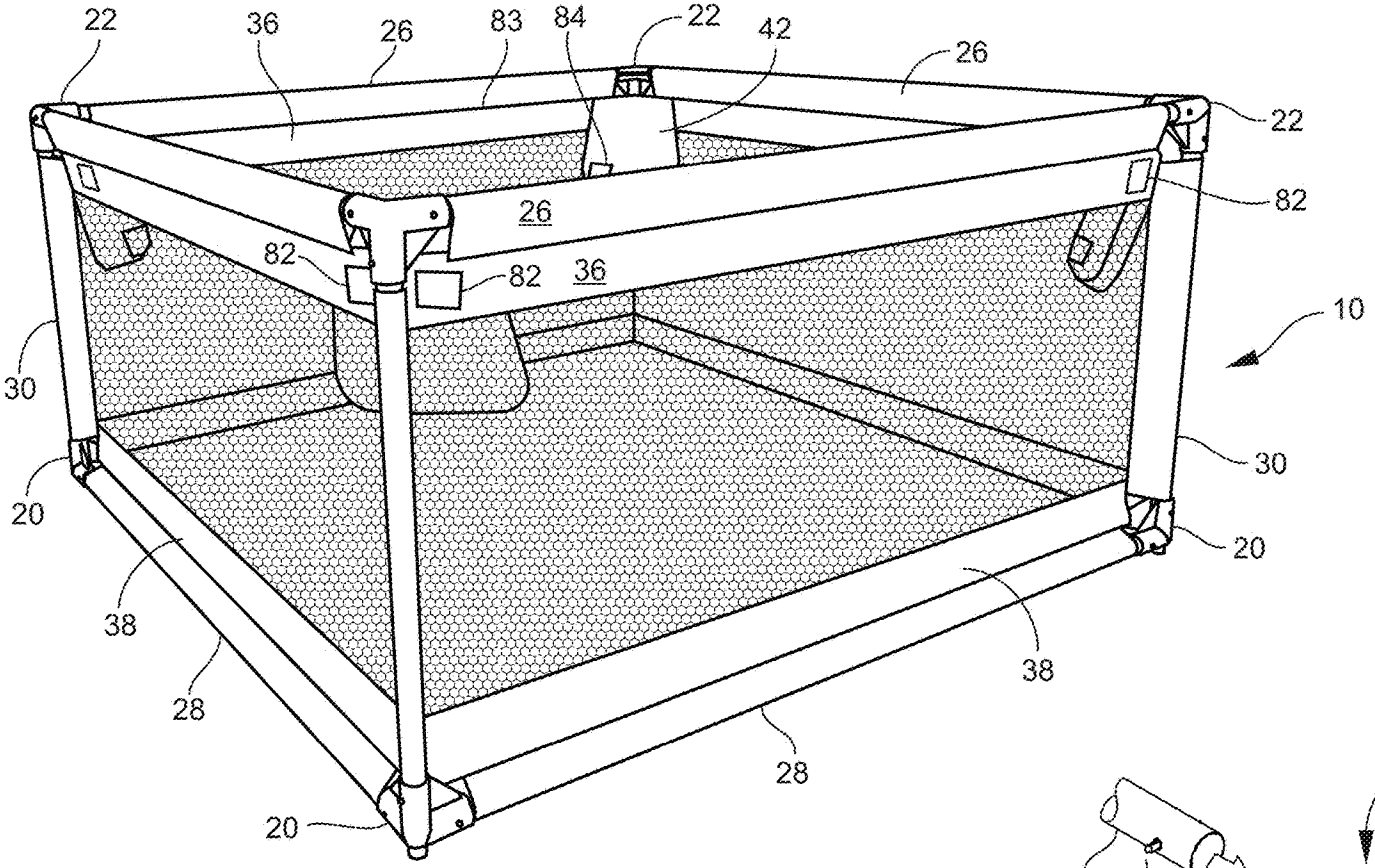
FIG. 8A is a perspective view of the playyard of FIG. 1 being assembled, with the uppermost horizontal support members having been inserted into the uppermost horizontal sleeves and engaged to the upper corner connections, leaving corner flaps in an unengaged position inside of the playyard.

FIG. 8A shows that the uppermost sleeves 26 have accepted therein and have been engaged to the uppermost horizontal support members 14 and that the uppermost horizontal support members 14 have been engaged to the upper corner connections 22.

Figure 8B:
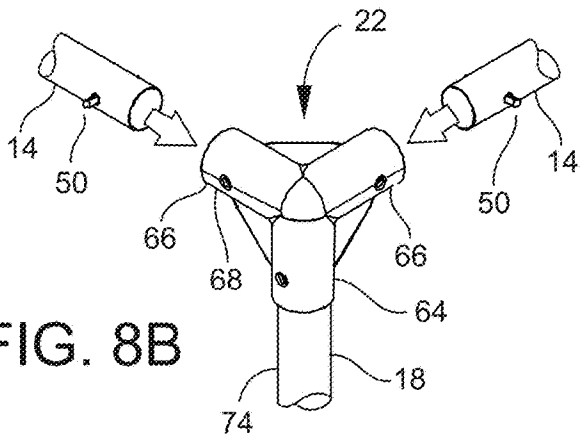
FIG. 8B is a detailed perspective view of the upper corner connection of FIG. 2E about to be engaged to adjacent ends of two uppermost horizontal support members of FIG. 3A.

In FIG. 8B, it can be seen that the outer ends of the uppermost horizontal support member 14 have been slid into and releasably locked with sockets 66 of the upper corner connection 22. There are two types of engagement here at each of the sockets 66: a male/female engagement between socket 66 and the outer end of the horizontal support member 14 and a pin and pin hole engagement between pin 50 of such outer end and pin hole 68 of the socket 66.

In FIG. 8A, bases 82 can be seen. Bases 82 are engaged to an outer face of upper fabric band 36 at a location adjacent to corner post sleeve 30. The outer face of base 82 includes one of a hook or loop fabric connector such as Velcro®.

In FIG. 8A, flaps 42 can be seen. Flaps 42 are flexible and are engaged at a junction 83 formed between uppermost sleeve 26 and upper fabric band 36. In the unengaged state shown in FIG. 8A, flaps 42 hang down from the junction 83.

Figure 9A:
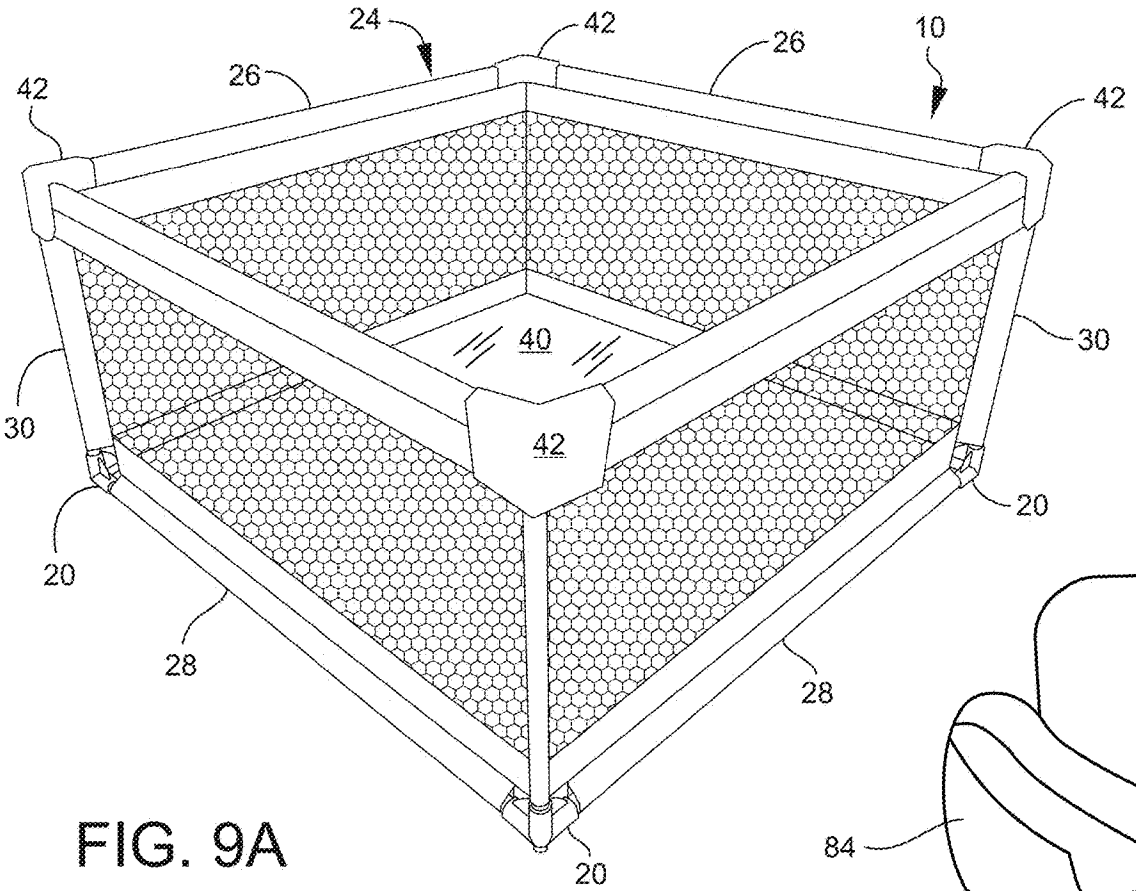
FIG. 9A is FIG. 1 repeated, showing the corner flaps having been engaged relative to FIG. 8A and thus completion of the assembly of the playyard of FIG. 1.
Figure 9B:
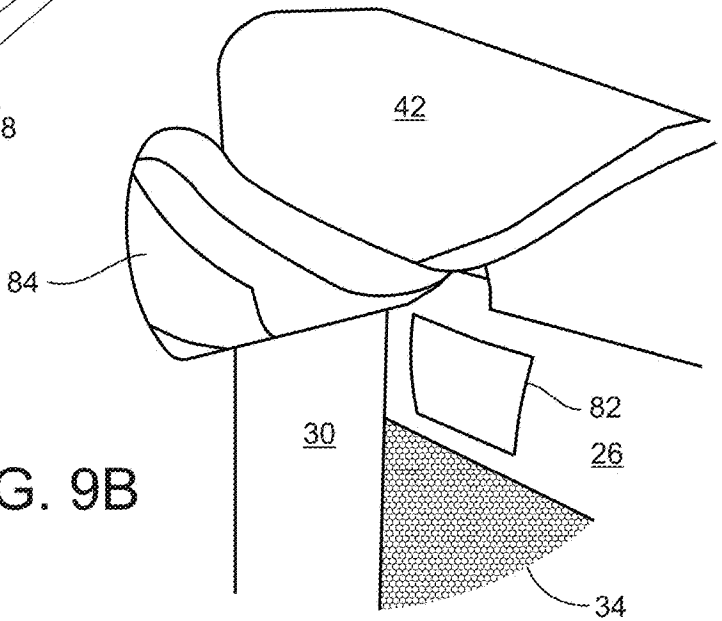
FIG. 9B is a perspective view of a corner portion of the playyard of FIG. 9B, showing a corner flap having a first hook/loop connector in the process of being engaged to a second hook/loop connector disposed on a side of the playyard of FIG. 9A.

FIG. 9A can be compared to FIG. 8A. In FIG. 9A, the flaps 42 have been swung up and over the upper corner connections 22 and then flexibly turned downward to engage bases 82. FIG. 9B shows that the underside of flap 42 includes a base 84. Base 84 includes a face having the other of a hook or loop fabric connector such as Velcro® such that the bases 82, 84 engaged each other with a macroscopic hook and loop fabric connection to secure the flap 42 over the upper corner connection 22 and to hide from sight the upper corner connection 22. Flap 42 has a width and length greater than a width and height of the upper corner connection 22. There are two bases 82 disposed adjacent to each of the upper corner connections 22 and there are two bases 84 on each of the flaps 42 to engage such two bases 82. FIG. 9A shows the playyard 10 completely set up for use.

Figure 10A:
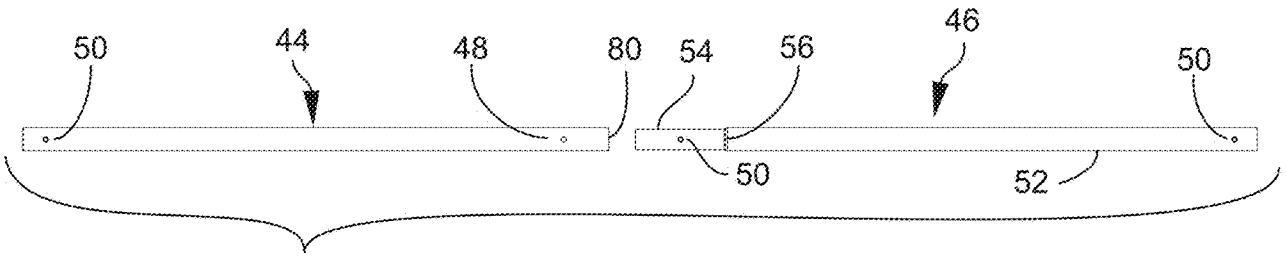
FIG. 10A is a side view of male and female pieces of a lowermost horizontal support member, where the male and female pieces are adjacent to each other and about to be engaged to each other.
Figure 10B:
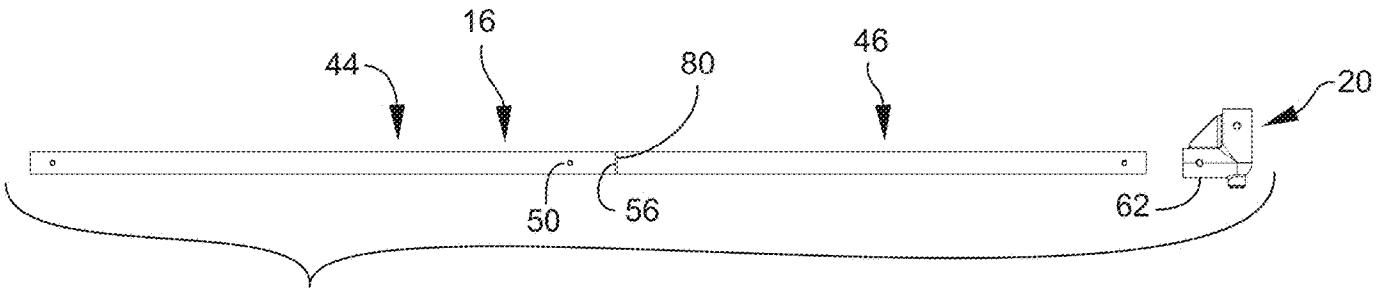
FIG. 10B is a side view of the lowermost horizontal support member of FIG. 10A where the male and female pieces are engaged to each other, and further shows a side view of a first lower corner connection adjacent to and about to be engaged with the outer end of the male piece of the lowermost horizontal support member.
Figure 10C:
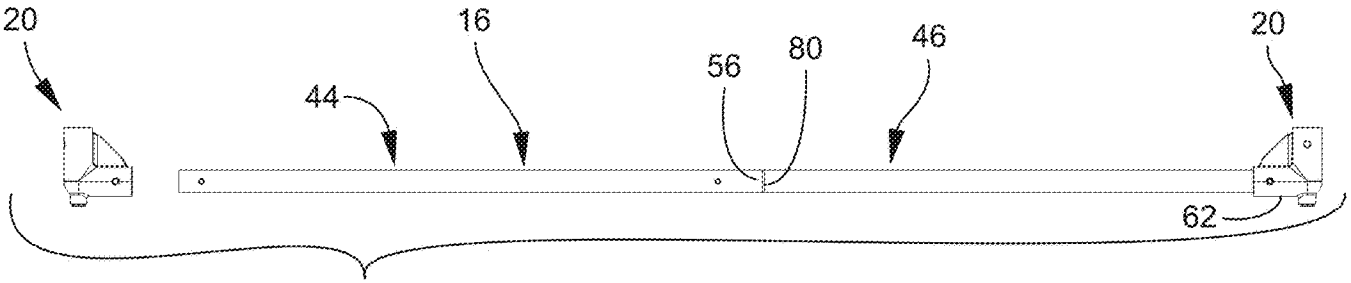
FIG. 10C is a side view of the lowermost horizontal support member of FIG. 10A, and further shows a side view of a pair of lower corner connections, where one of the lower corner connections has been engaged to the male piece and where the other of the lower corner connections is adjacent to and about to be engaged with the outer end of the female piece of the lowermost horizontal support member.

FIG. 10A shows the male piece 46 and the female piece 44 where the male piece 46 and female piece 44 are adjacent to each other and about to be engaged to each other. FIG. 10B shows the male piece 46 and female piece 44 of FIG. 10A engaged to each other, and further shows a first lower corner connection 20 adjacent to and about to be engaged with the outer end of the male piece 46 of the lowermost horizontal support member 16. FIG. 10C shows the lowermost horizontal support member 16 of FIG. 10B, and further shows a pair of lower corner connections 20, where one of the lower corner connections 20 has been engaged to the male piece 46 and where the other of the lower corner connections 20 is adjacent to and about to be engaged with the outer end of the female piece 44 of the lowermost horizontal support member 16. FIGS. 10B and 10C show the annular stop edge 80 abutting the annular stop 56 of the male piece 46. In order from FIG. 10A to FIG. 10B to FIG. 10C, such figures show engagement. In order from FIG. 10C to FIG. 10B to FIG. 10A, such figures show disengagement or release of the components from each other.

Figures 11A, 11B:
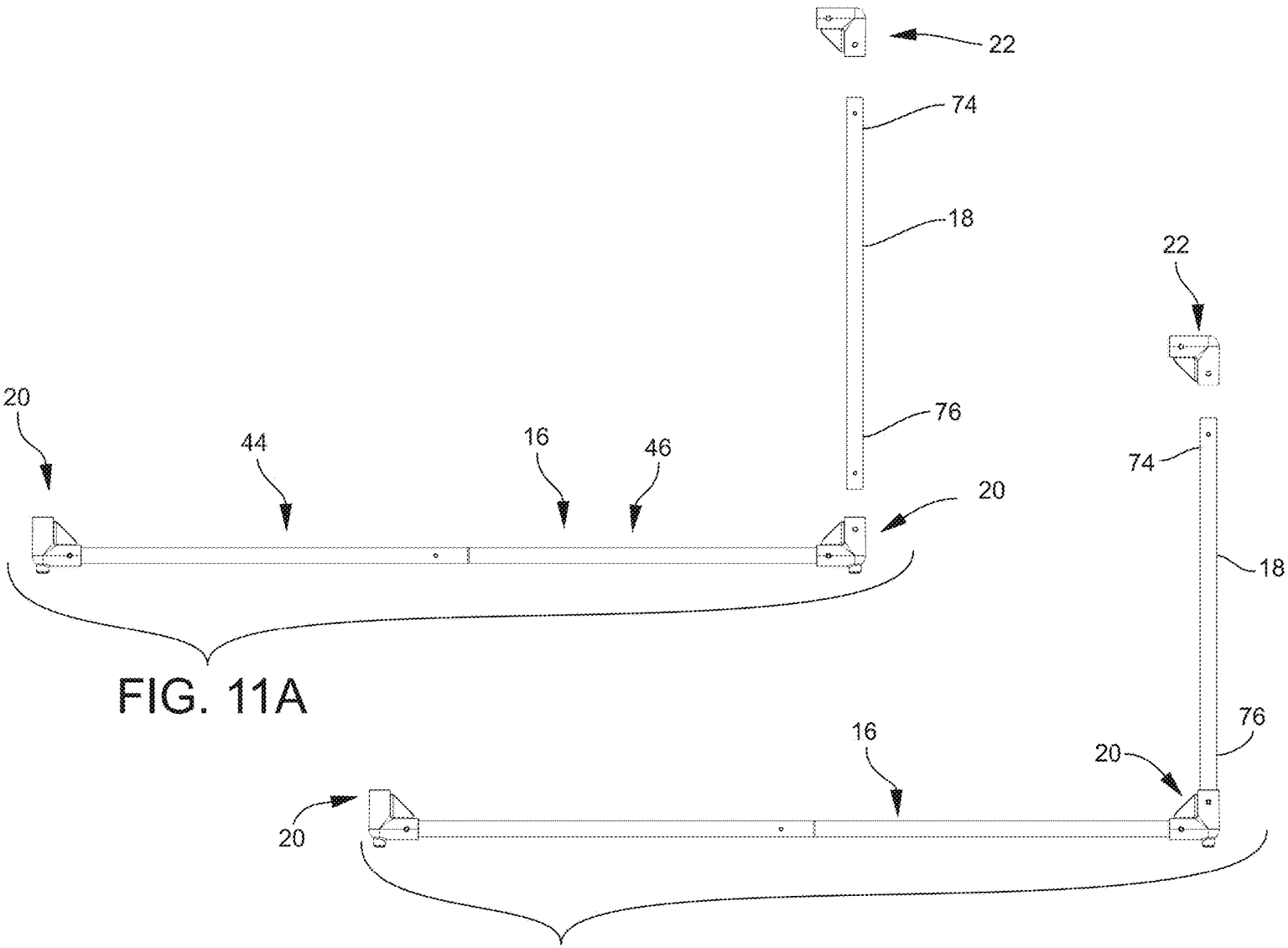
FIG. 11A is a side view of a lowermost horizontal support member engaged to lower corner connections, with a lower end of a corner post about to be engaged to one of the lower corner connections and with an upper end of the corner post about to be engaged with an upper corner connection.
FIG. 11B is a side view of the lowermost horizontal support member of FIG. 11A, of the corner post of FIG. 11A engaged in a lower corner connection, and of the upper corner connection of FIG. 11B about to be engaged to the upper end of the corner post.

FIG. 11A shows the lowermost horizontal support member 16 of FIG. 10C having been engaged to first and second lower corner connections 20, with the lower end 76 of corner post 18 about to be engaged to one of the lower corner connections 20 and with the upper end 74 of the corner post 18 about to be engaged with the upper corner connection 22. FIG. 11B shows the lowermost horizontal support member 16 of FIG. 11A and the corner post 18 of FIG. 11A engaged in a lower corner connection 20, and further shows the upper corner connection 22 of FIG. 11B about to be engaged to the upper end 74 of the corner post 18. FIG. 11B shows that an axis of lowermost support member 16 is disposed at a right angle to the axis of corner post 18 when the lowermost support member 16 and corner post 18 are engaged to the lower corner connection.

Figure 12A:
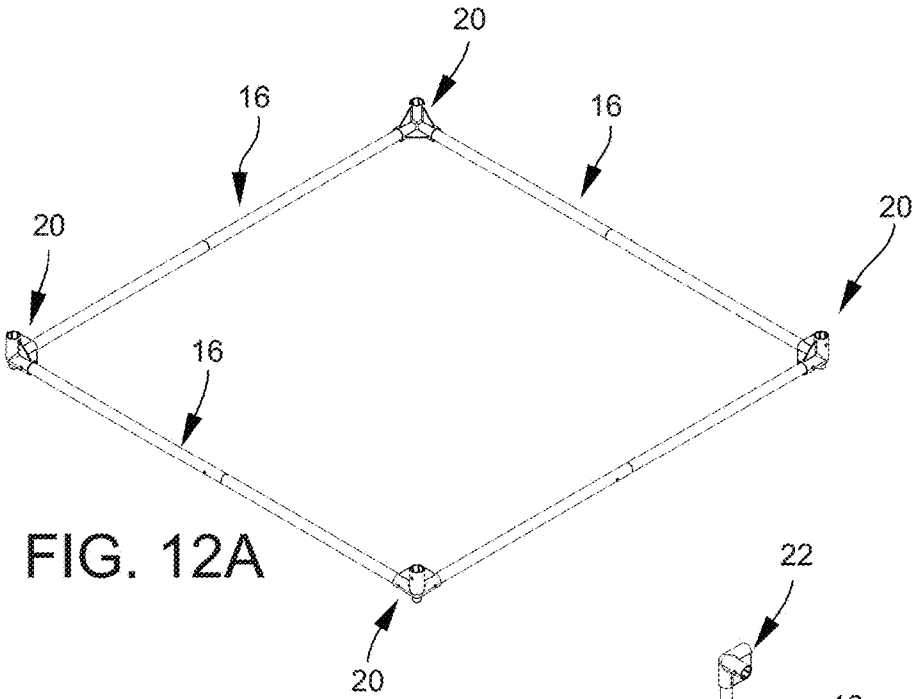
FIG. 12A is a perspective view of a set of four lowermost horizontal support members engaged with a set of four lower corner connections.
Figure 12B:
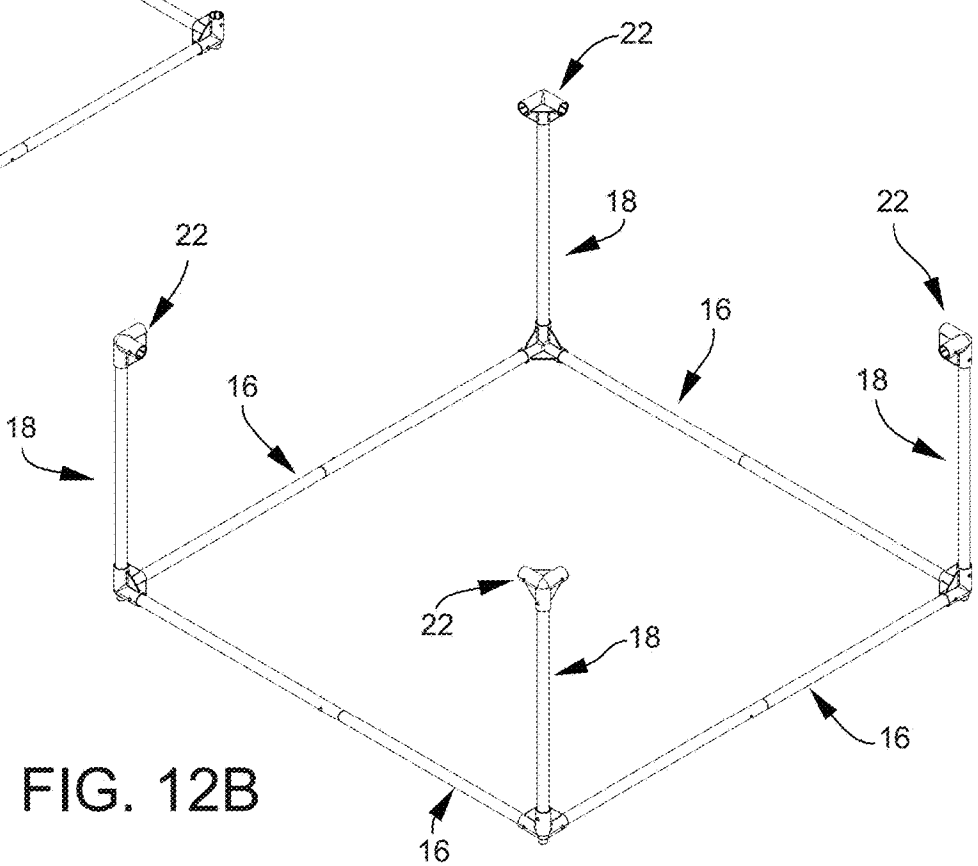
FIG. 12B is a perspective view of a set of four lowermost horizontal support members engaged with a set of four lower corner connections, which in turn is engaged with a set of four corner posts, which in turn is engaged with a set of four upper corner connections.

FIG. 12A shows a set of four lowermost horizontal support members 16 engaged with a set of four lower corner connections 20. FIG. 12B shows the set of four lowermost horizontal support members 16 of FIG. 12A engaged with the set of four lower corner connections 20 of FIG. 12A, which in turn is engaged with a set of four corner posts 18, which in turn is engaged with a set of four upper corner connections 22. The axes of the first, second, third, and fourth lowermost horizontal support members 16 of FIGS. 12A and 12B define a square.

Figure 13:
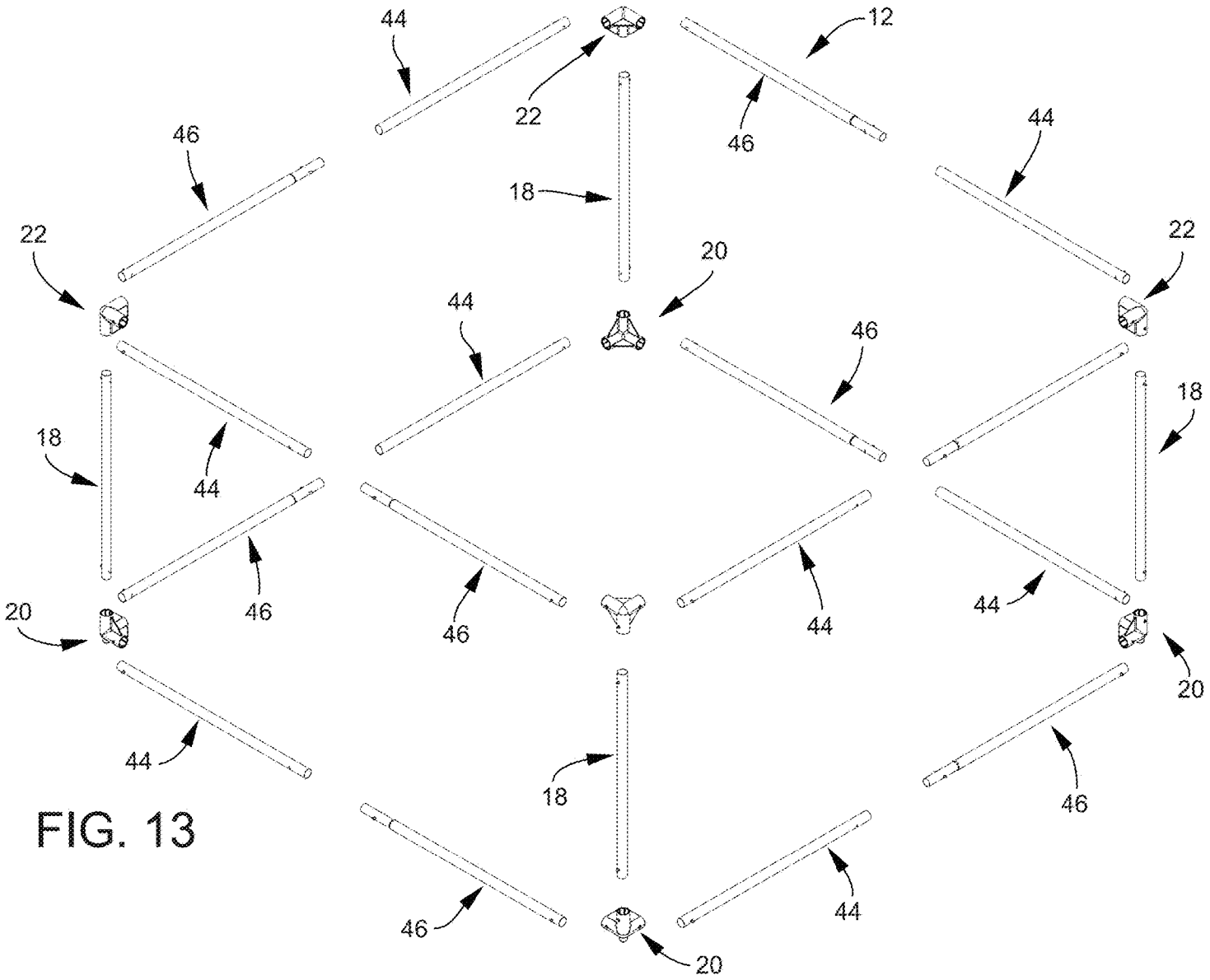
FIG. 13 is a perspective broken apart view of the frame of the playyard of FIG. 1, where the frame includes four lowermost horizontal support members, four uppermost horizontal support members, four corner posts, four lower corner connections, and four upper corner connections, and where each of the lowermost and uppermost horizontal support members includes a female piece and a male piece.

FIG. 13 shows a broken apart view of the frame 12 of the playyard 10 of FIG. 1. Frame 12 includes four lowermost horizontal support members 16, four uppermost horizontal support members 14, four corner posts 18, four lower corner connections 20, and four upper corner connections 22, where each of the uppermost and lowermost horizontal support members 14, 16 includes a female piece 44 and a male piece 46. Frame 12, as shown in FIG. 13, can be set up to the state shown in FIG. 14 without destroying an integrity of any of the components 14, 16, 18, 20, 22, 44, and 46.

Figure 14:
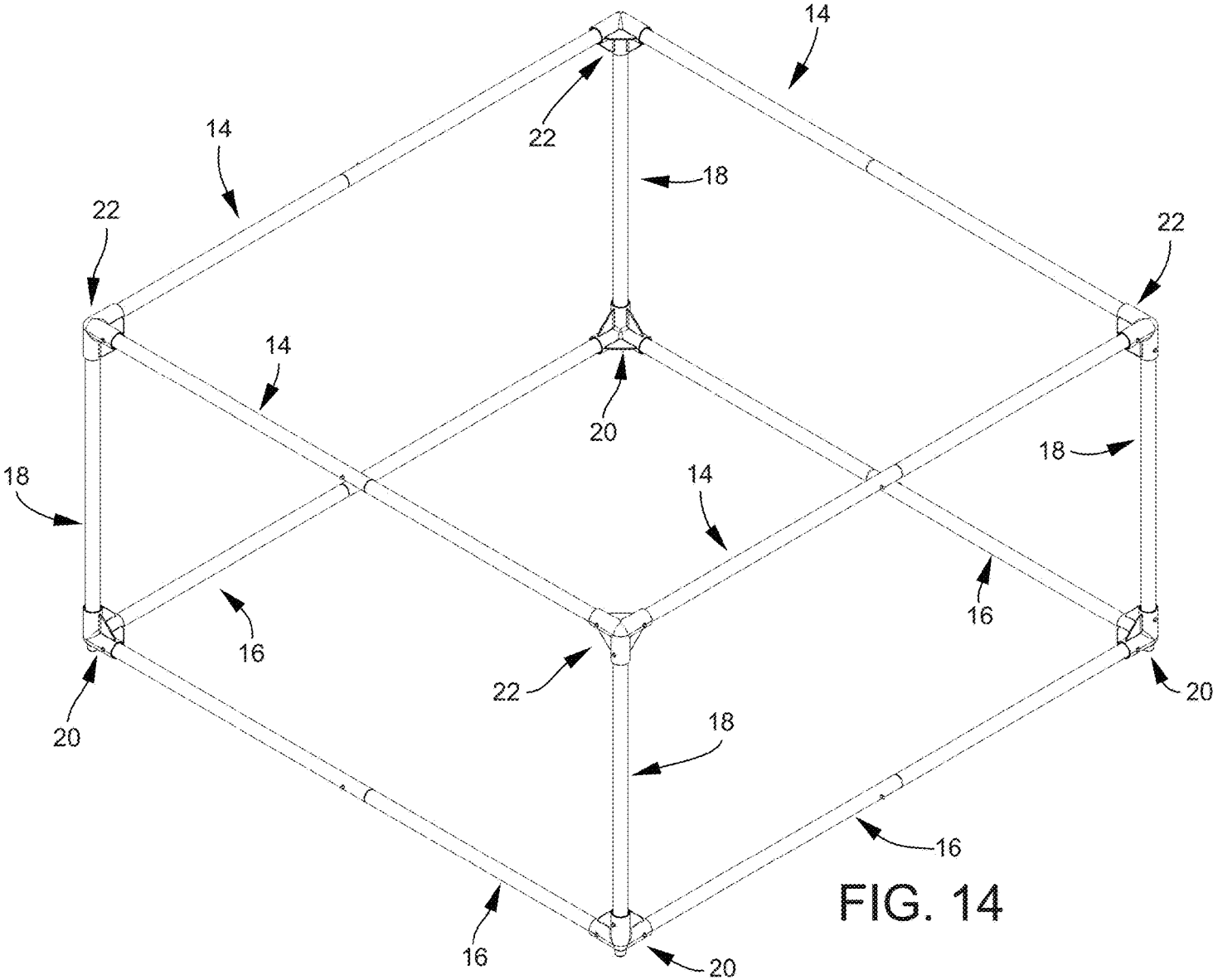
FIG. 14 is a perspective view of the broken apart frame of FIG. 13 assembled.

FIG. 14 shows an assembled view of the frame 12 of the playyard 10 of FIG. 1. Frame 12 includes four lowermost horizontal support members 16, four uppermost horizontal support members 14, four corner posts 18, four lower corner connections 20, and four upper corner connections 22, where each of the uppermost and lowermost horizontal support members 14, 16 includes a female piece 44 and a male piece 46. Frame 12, as shown in FIG. 14, can be taken down to the state shown in FIG. 13 without destroying an integrity of any of the components 14, 16, 18, 20, 22, 44, and 46. The axes of the lowermost horizontal support members 16 define a square. The axes of the uppermost horizontal support members 14 define a square. The axes of a pair of uppermost and lowermost horizontal support members 14, 16 and the axes of corner posts 18 that are adjacent to such pair define a rectangle. The lowermost horizontal support members 16 define a first plane and the lowermost portions of feet 73 define a second plane, with the first and second planes being adjacent to each other and spaced from each other so as to space floor 40 from a lower surface such as grass, sand, dirt, or another environmental surface on which the feet 73 rest.

Figure 15B:
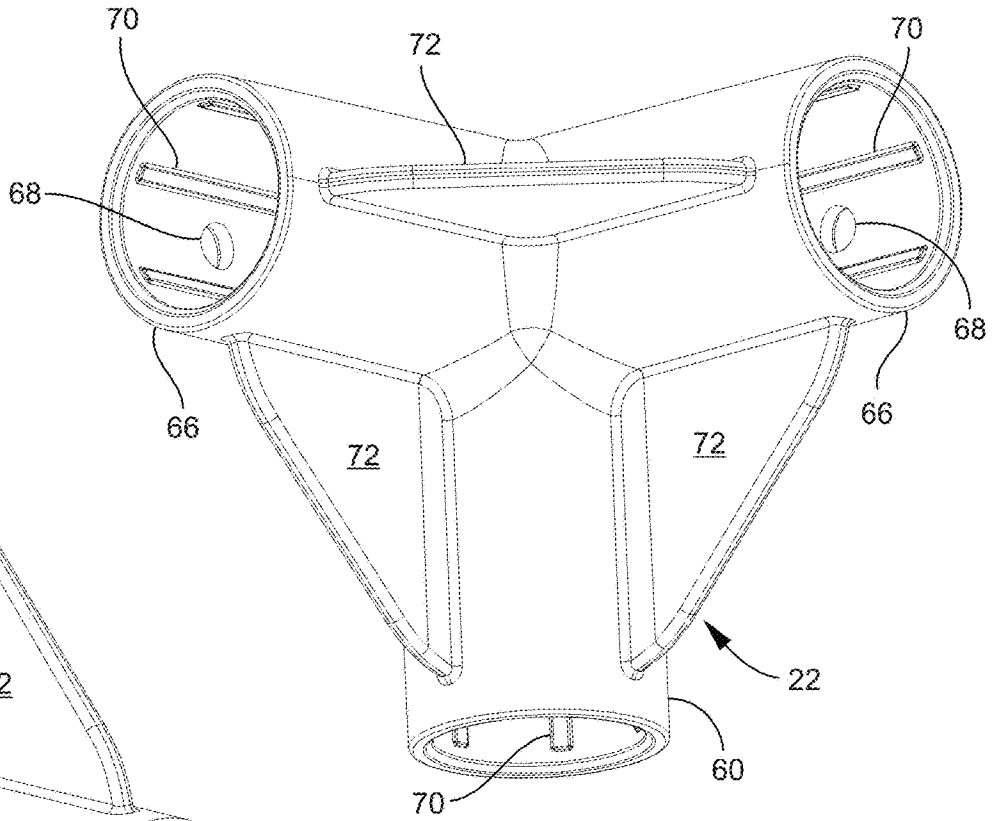
FIG. 15B is a perspective detail view of the upper corner connection of FIG. 2E.
Figure 15A:
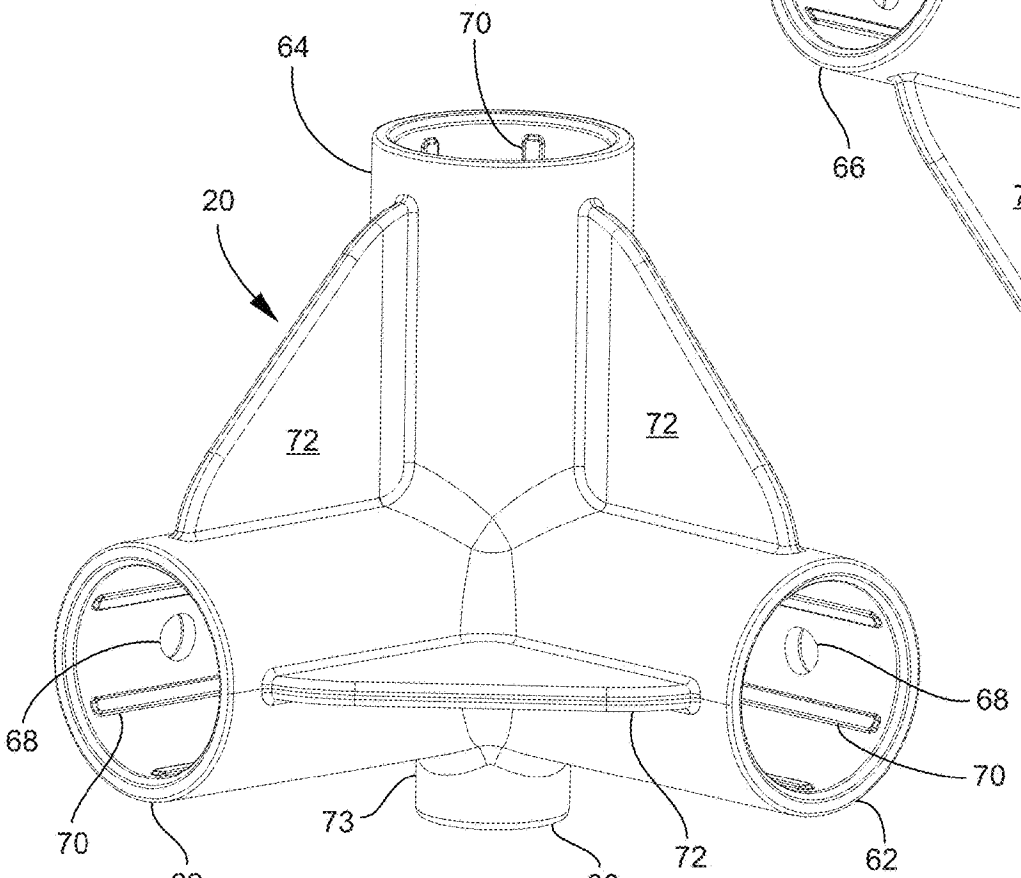
FIG. 15A is a perspective detail view of the lower corner connection of FIG. 2D.

FIG. 15A shows a detail view of the lower corner connection 20 of FIG. 2D. FIG. 15B shows a detail view of the upper corner connection 22 of FIG. 2E. The lower and upper corner connections 20, 22 have also been described with respect to FIG. 5B, FIG. 6B, FIG. 7B, FIG. 8B, and other figures. FIG. 15A shows that foot 73 includes a bottommost disk portion 86 that may be formed of a non-slip rubber or elastomeric material to minimize slippage, for example, on a hardwood floor or tiled floor of a residence. The bottommost surface of the disk portion 86 may be concave where the concave portion extends inwardly and upwardly from the outermost edges of the disk portion 86.

Figure 16A:
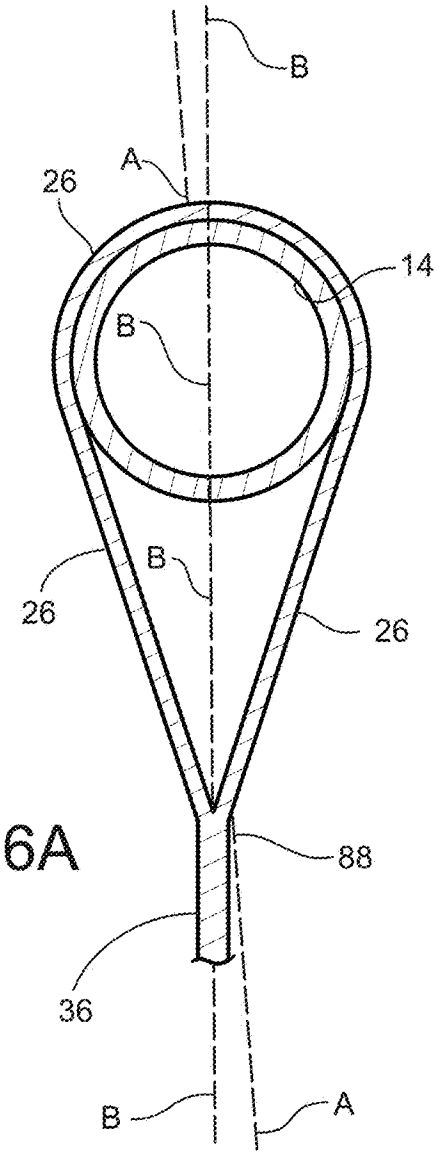
FIG. 16A is a section view of an uppermost horizontal support member of the frame of FIG. 1 taken vertically so as to show an uppermost sleeve and a portion of the sidewall of the sheeting, where the sidewall is disposed obliquely to a plane defined by horizontal axes of the uppermost and lowermost horizontal support members.

FIG. 16A shows a section taken along a vertical plane of an upper portion of the playyard of FIG. 1. FIG. 16A shows the uppermost horizontal support member 14, the uppermost sleeve 26 and the fabric band 36. FIG. 16A further shows an axis A or straight line A that is coplanar with a first plane defined by the axes of the uppermost and lowermost horizontal support members 14, 16 that are paired with each other. Axis A extends through the center of uppermost horizontal support member 14. FIG. 16A further shows a straight line B defined by a second plane. Upper band 36 lies in the second plane, as does the mesh section 34, the lower band 38, and the point of the teardrop shaped uppermost sleeve 26. The point of the teardrop shaped uppermost sleeve 26 lies on a junction 88, where the junction 88 is a junction between the uppermost sleeve 26 and the upper band 36. Junction 88 is shown in FIGS. 1 and 16A. Uppermost band 36, mesh section 34, and lowermost band 38 are coplanar and such second plane is disposed obliquely to the first plane defined by the longitudinal axes of the uppermost and lowermost horizontal support members 14, 16.

FIG. 16B shows a section taken along a vertical plane of a lower portion of the playyard of FIG. 1. FIG. 16B shows the lowermost horizontal support member 16, the lowermost sleeve 28, the fifth sheeting portion 40 or floor 40, and the lower band 38. FIG. 16B further shows axis A or straight line A, which is the same axis A shown in FIG. 16A. As indicated above, axis A is coplanar with a first plane defined by the axes of the uppermost and lowermost horizontal support members 14, 16 that are paired with each other. Axis A extends through the center of lowermost horizontal support member 16 shown in FIG. 16B. In FIG. 16B, to the left of axis A, is an axis C. Axis C lies in a plane parallel to axis A. FIG. 16B further shows straight line B, which is the same straight line B shown in FIG. 16A. FIG. 16B shows that lower band 38 is in the plane defined by axis B. Axis B is oblique to axis C and is thus also oblique to axis A. Lower band 38 leads into mesh section 34 that in turn leads into upper band 36. FIG. 16B further shows axis D or straight line D. FIG. 16B shows that floor 40 or fifth sheeting portion 40 lies in a plane in which axis D lies. As shown in FIG. 16B, a point of lowermost sleeve 28, lower band 38, and floor 40 define a junction 90 shown in FIGS. 1 and 16B. Putting FIGS. 16A and 16B together, it can be appreciated that junction 90 is spaced from a plane defined by uppermost and lowermost horizontal support members 14, 16 and that junction 88 is adjacent to the plane defined by the uppermost and lowermost horizontal support members 14, 16. It can also be appreciated that lower band 38, mesh section 34, and upper band 36 are oblique to the floor 40 as well as being oblique to the plane defined by the uppermost and lowermost horizontal support members 14, 16. From FIGS. 16A and 16B, it can be appreciated that floor 16 has a perimeter defined by first, second, third, and fourth junctions 90. From FIGS. 16A and 16B, it can be appreciated that first, second, third, and fourth junctions 90 define a lower square, that first, second, third, and fourth junctions 88 define an upper square, and that the upper square covers more area than the lower square or that the area enclosed by the upper square is greater than the area enclosed by the lower square. Such a structure, with the perimeter of the floor 40 defining a square of a lesser area than a) the larger square defined by the lowermost horizontal support members 16 that defines a greater area, and b) the larger square defined by the uppermost horizontal support members 14, contributes to a taut or tight sheeting fit within the frame 12 where the sheeting 24 draws inwardly the uppermost and lowermost horizontal support members 14, 16.

Figure 17:
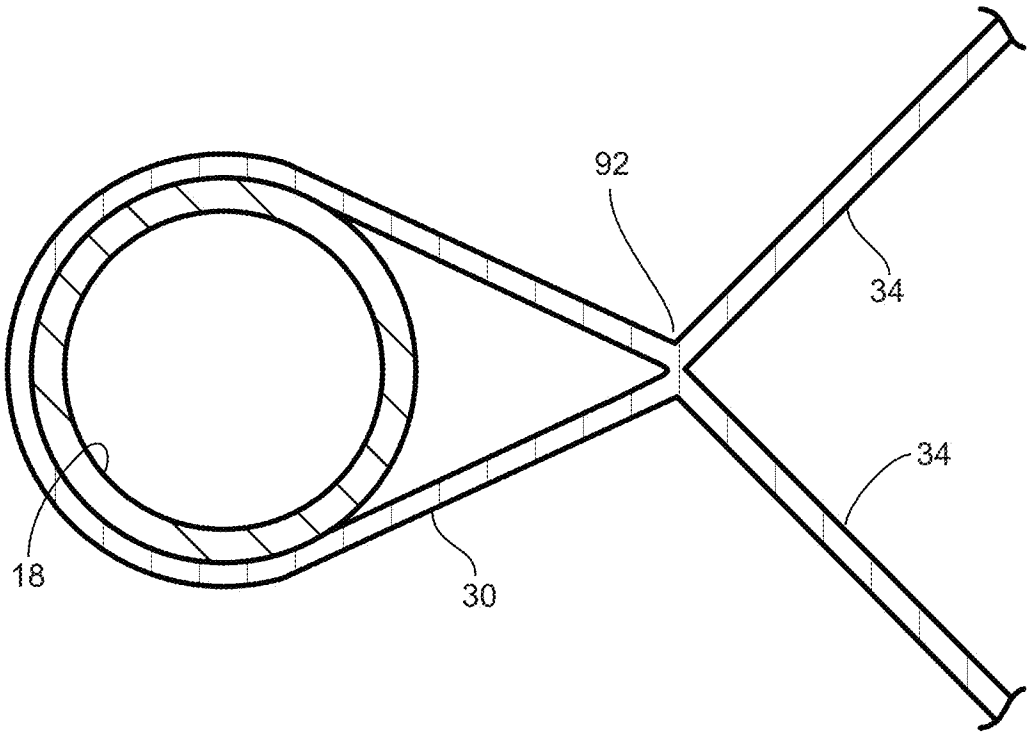
FIG. 17 is a section view of a corner sleeve engaging a corner post taken horizontally, where the corner sleeve transitions into first and second sidewalls of the sheeting.

FIG. 17 is a section taken along a horizontal plane of an intermediate portion of the playyard of FIG. 1. FIG. 17 shows the teardrop shape of the corner post sleeves 30. FIG. 17 shows the right angle relationship between two adjacent mesh sections 34. FIG. 17 shows the vertical junction 92 defined by the intersection of two adjacent mesh sections 34 and the corner post sleeve 30. From FIG. 8A, it can be appreciated that junction 92 and corner post sleeve 30 has a greater height than mesh section 34 and that corner post sleeve 30 has an uppermost end adjacent to an upper corner connection 22 and that corner post sleeve 30 has a lowermost end adjacent to a lower corner connection 22. From FIG. 8A, it can be appreciated that uppermost sleeve 26 engaging the uppermost horizontal support member 14 has a lesser length than the upper band 36 and also has a lesser length than the mesh section 34. Uppermost sleeve 26 has a first end adjacent to one uppermost corner connection 22 and a second end adjacent to another uppermost corner connection 22.

Figure 18:
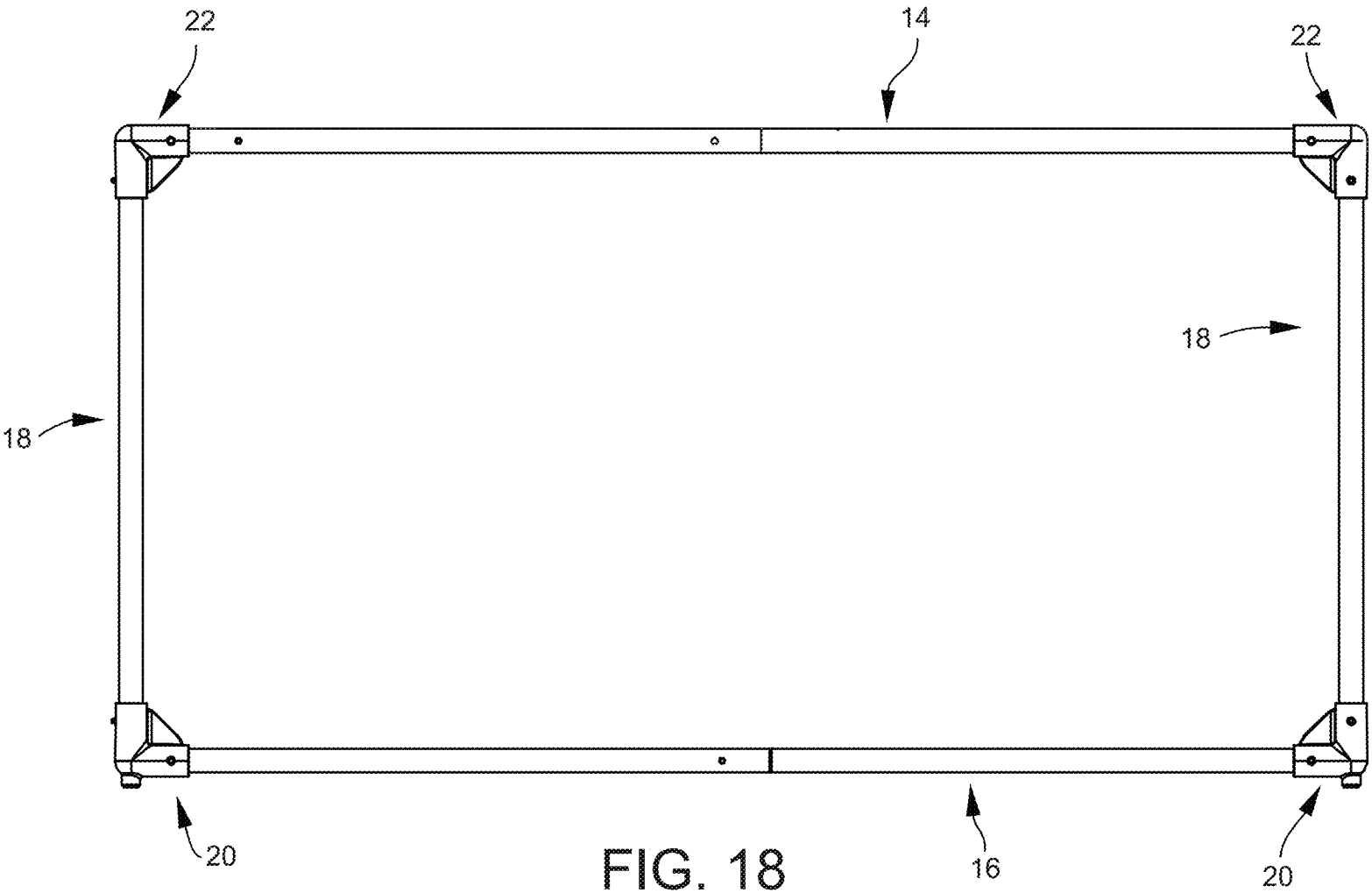
FIG. 18 is a front elevation view of any of the four sides of the playyard frame of FIG. 14 showing that a ratio of the height of the corner post to the length of one of the uppermost and lowermost horizontal support members is about one to two.

FIG. 18 shows that the length to height ratio of the playyard 10 is about two to one. In other words, the length of an uppermost horizontal support member 14 plus a portion of one upper corner connection 22 plus a portion of another upper corner connection 22 is about 51 inches, while the height of a corner post 18 plus a portion of an upper corner connection 22 plus a portion of a lower corner connection 20 is about 26.5 inches, which is about a 1.92 to 1.0 ratio. Likewise, the length of an lowermost horizontal support member 16 plus a portion of one lower corner connection 20 plus a portion of another lower corner connection 20 is about 51 inches, while the height of a corner post 18 plus a portion of an upper corner connection 22 plus a portion of a lower corner connection 20 (without considering the foot 73) is about 26.5 inches, which is about a 1.92 to 1.0 ratio. For the square playyard 10, the length of the frame 12 of the playyard 10 is preferably between about 1.80 units and about 2.20 units where the height of the frame 12 of the playyard 10 is 1.0 units without considering the foot 73, where such length is more preferably between about 1.85 units and about 2.10 units where the height of the frame 12 of the playyard 10 is 1.0 units without considering the foot 73, and where such length is most preferably between about 1.90 units and about 2.10 units where the height of the frame 12 of the playyard is 1.0 units without considering the foot 73.

Figure 19B:
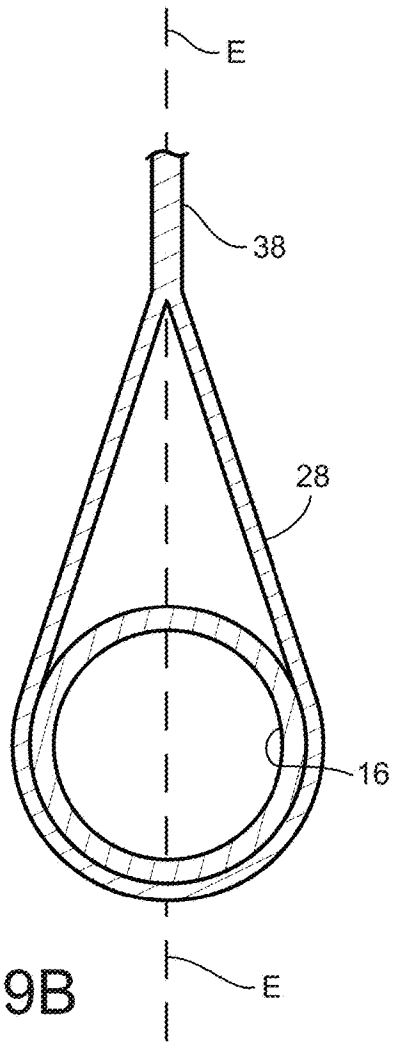
FIG. 19B is a section of the embodiment of the playyard of FIG. 19B where the playyard has no floor, and shows the teardrop of the lowermost sleeve for the lowermost horizontal support member pointing straight upwardly.
Figure 19A:
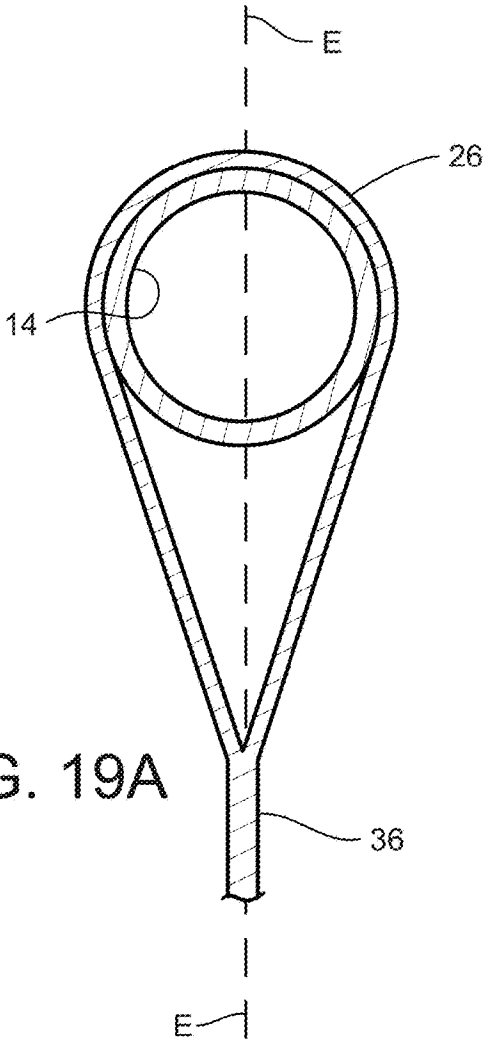
FIG. 19A is a section of an embodiment of the playyard where the playyard has no floor, and shows the teardrop of the uppermost sleeve for the uppermost horizontal support member pointing straight downwardly.

FIG. 19A is a section an embodiment of the playyard 10 where the playyard 10 has no floor 40, and shows the teardrop of the uppermost sleeve 26 for the uppermost horizontal support member 14 pointing straight downwardly. FIG. 19B is a section of the embodiment of the playyard 10 of FIG. 19B where the playyard 10 has no floor 40, and shows the teardrop of the lowermost sleeve 28 for the lowermost horizontal support member 16 pointing straight upwardly. FIGS. 19A and 19B show an axis E or straight line E that lies in a plane defined by the axes of the uppermost and lowermost horizontal support members 14, 16. In the embodiment of the playyard 10 having no floor 40, the teardrop shape of the uppermost sleeve 26 points straight downwardly and leads into the upper band 36, which in turn leads into the mesh section 34, which in turn leads into the lower band 38, which in turn leads into the point of the lowermost sleeve 28 that engages the lowermost horizontal support member 16. In this embodiment of the playyard 10 with no floor 40, the upper band 36, the mesh section 34, and the lower band 38 are disposed in a common plane, which common plane includes axis E.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A playyard comprising:

a) a frame comprising:

i) no more and no less than first, second, third, and fourth corner posts such that the playyard includes no more and no less than four corner posts, each of the first, second, third, and fourth corner posts being one-piece;

ii) no more and no less than a pair of first uppermost and lowermost horizontal support members extending between the first and second corner posts;

iii) no more and no less than a pair of second uppermost and lowermost horizontal support members extending between the second and third corner posts;

iv) no more and no less than a pair of third uppermost and lowermost horizontal support members extending between the third and fourth corner posts;

v) no more and no less than a pair of fourth uppermost and lowermost horizontal support members extending between the fourth and first corner posts;

vi) each of said first, second, third, and fourth uppermost and lowermost horizontal support members being no more and no less than two pieces such that each of said first, second, third, and fourth uppermost and lowermost support members include first and second horizontal pieces, the first and second horizontal pieces being engaged to each other by a male/female connection at inner ends of the first and second horizontal pieces;

vii) each of said first, second, third, and fourth uppermost and lowermost horizontal support members having outer ends and extending directly from a corner post to a corner post such that said first, second, third, and fourth uppermost and lowermost horizontal support member derive sole hardware support from said outer ends engaging respective corner posts;

viii) no more and no less than first, second, third, fourth, fifth, sixth, seventh, and eighth corner connections, each of the first, second, third, fourth, fifth, sixth, seventh, and eighth corner connections being one-piece;

ix) the first and second corner connections engaging respective upper and lower ends of the first corner post and further engaging, respectively, the first and fourth uppermost horizontal support members and first and fourth lowermost horizontal support members;

x) the third and fourth corner connections engaging respective upper and lower ends of the second corner post and further engaging, respectively, the first and second uppermost horizontal support members and first and second lowermost horizontal support members;

xi) the fifth and sixth corner connections engaging respective upper and lower ends of the third corner post and further engaging, respectively, the second and third uppermost horizontal support members and second and third lowermost horizontal support members;

xi) the seventh and eighth corner connections engaging respective upper and lower ends of the fourth corner post and further engaging, respectively, the third and fourth uppermost horizontal support members and the third and fourth lowermost horizontal support members;

b) sheeting comprising:

i) a first sheeting portion extending to and between the first uppermost and lowermost horizontal support members, the first sheeting portion having a first uppermost sleeve for the first uppermost horizontal support member and a first lowermost sleeve for the first lowermost horizontal support member, the first sheeting portion further extending to and between the first and second corner posts, the first sheeting portion having a first sleeve portion engaging the first corner post and a second sleeve portion engaging the second corner post;

ii) a second sheeting portion extending to and between the second uppermost and lowermost horizontal support members, the second sheeting portion having a second uppermost sleeve for the second uppermost horizontal support member and a second lowermost sleeve for the second lowermost horizontal support member, the second sheeting portion further extending to and between the second and third corner posts, the second sheeting portion having the second sleeve portion engaging the second corner post and further having a third sleeve portion engaging the third corner post;

iii) a third sheeting portion extending to and between the third uppermost and lowermost horizontal support members, the third sheeting portion having a third uppermost sleeve for the third uppermost horizontal support member and a third lowermost sleeve for the third lowermost horizontal support member, the third sheeting portion further extending to and between the third and fourth corner posts, the third sheeting portion having the third sleeve portion engaging the third corner post and further having a fourth sleeve portion engaging the fourth corner post;

iv) a fourth sheeting portion extending to and between the fourth uppermost and lowermost horizontal support members, the fourth sheeting portion having a fourth uppermost sleeve for the fourth uppermost horizontal support member and a fourth lowermost sleeve for the fourth lowermost horizontal support member, the fourth sheeting portion further extending to and between the fourth and first corner posts, the fourth sheeting portion having the fourth sleeve portion engaging the fourth corner post and the first sleeve portion engaging the first corner post;

c) the first uppermost horizontal support member engaging the first and third corner connections and in combination therewith defining a first sidewall length, the first lowermost horizontal support member engaging the second and fourth corner connections and in combination therewith defining the first sidewall length, the first corner post engaging the first and second corner connections and in combination therewith defining a first corner height;

d) the second uppermost horizontal support member engaging the third and fifth corner connections and in combination therewith defining a second sidewall length, the second lowermost horizontal support member engaging the fourth and sixth corner connections and in combination therewith defining the second sidewall length, the second corner post engaging the third and fourth corner connections and in combination therewith defining a second corner height;

e) the third uppermost horizontal support member engaging the fifth and seventh corner connections and in combination therewith defining a third sidewall length, the third lowermost horizontal support member engaging the sixth and eighth corner connections and in combination therewith defining the third sidewall length, the third corner post engaging the fifth and sixth corner connections and in combination therewith defining a third corner height;

f) the fourth uppermost horizontal support member engaging the seventh and first corner connections and in combination therewith defining a fourth sidewall length, the fourth lowermost horizontal support member engaging the eighth and second corner connections and in combination therewith defining the fourth sidewall length, the fourth corner post engaging the seventh and eighth corner connections and in combination therewith defining a fourth corner height; and g) a ratio of the first sidewall length to the first corner height being about two to one, a ratio of the second sidewall length to the second corner height being about two to one, a ratio of the third sidewall length to the third corner height being about two to one, and a ratio of the fourth sidewall length to the fourth corner height being about two to one.

2. The playyard of claim 1, and further comprising a fifth sheeting portion, the fifth sheeting portion extending to and between the first and third lowermost sleeves and the fifth sheeting portion further extending to and between the second and fourth lowermost sleeves such that the fifth sheeting portion provides a floor for the playyard.

3. The playyard of claim 2, wherein each of the second, fourth, sixth, and eighth corner connections includes a lowermost portion, the lowermost portions defining a first plane, and the floor being above the first plane.

4. The playyard of claim 1, wherein each of the first, second, third, and fourth uppermost sleeves extends inwardly relative to the frame, wherein each of the first, second, third, and fourth lowermost sleeves extends inwardly relative to the frame, and wherein each of the first, second, third, and fourth corner post sleeves extends inwardly relative to the frame.

5. The playyard of claim 1, wherein the playyard includes an open top, the open top being defined by the first, second, third, and fourth uppermost horizontal support members.

6. The playyard of claim 1, wherein the playyard includes an open bottom, the open bottom being defined by the first, second, third, and fourth lowermost horizontal support members.

7. The playyard of claim 1, wherein the playyard includes an open top and an open bottom, the open top being defined by the first, second, third, and fourth uppermost horizontal support members, the open bottom being defined by the first, second, third, and fourth lowermost horizontal support members.

8. The playyard of claim 1, wherein the male/female connection includes a spring biased pin engaging each of the first and second horizontal pieces.

9. The playyard of claim 1, wherein each of the first, second, third, fourth, fifth, sixth, seventh, and eighth corner connections includes first and second sockets for engaging horizontal support members, each of the first, second, third, fourth, fifth, sixth, seventh, and eight corner connections including a third socket for engaging a corner post, the first, second, and third sockets having respective first, second, and third axes, the first and second axes extending at a right angle to each other, the first and third axes extending at a right angle to each other, the second and third axes extending at a right angle to each other.

10. The playyard of claim 9, wherein each of the first, second, third, fourth, fifth, sixth, seventh, and eighth corner connections includes a first brace coplanar with the first axis, a second brace coplanar with the second axis, and a third brace coplanar with the third axis.

11. The playyard of claim 1, wherein the first, second, third, and fourth uppermost and lowermost horizontal support members define respective first, second, third, and fourth frame planes, wherein the first sheeting portion includes a first sheet section between the first uppermost and lowermost sleeves, wherein the second sheeting portion includes a second sheet section between the second uppermost and lowermost sleeves, wherein the third sheeting portion includes a third sheet section between the third uppermost and lowermost sleeves, wherein the fourth sheeting portion includes a fourth sheet section between the fourth uppermost and lowermost sleeves, wherein the first, second, third, and fourth sheet sections define first, second, third, and fourth sheet section planes, and wherein the first, second, third, and fourth sheet section planes are, respectively, disposed inwardly of, adjacent to, and obliquely of the first, second, third, and fourth frame planes.

12. The playyard of claim 2, wherein the fifth sheeting portion is taut such that an inward pressure is exerted on the first, second, third, and fourth lowermost sleeves, said inward pressure pulling on the first, second, third, and fourth lowermost horizontal support members.

13. The playyard of claim 2, wherein a perimeter of the fifth sheeting portion is less than a perimeter defined by a combination of a) the first, second, third, and fourth lowermost horizontal support members and b) the second, fourth, sixth, and eighth corner connections.

14. The playyard of claim 2, wherein:

a) a perimeter of the fifth sheeting portion is less than a perimeter defined by a combination of i) the first, second, third, and fourth lowermost horizontal support members and ii) the second, fourth, sixth, and eighth corner connections;

b) wherein the fifth sheeting portion includes first, second, third, and fourth outermost edges defining the perimeter of the fifth sheeting portion, the first, second, third, and fourth lowermost sleeves engaging, respectively, the first, second, third, and fourth outermost edges;

c) wherein the first uppermost and lowermost horizontal support members define a first plane, wherein the second uppermost and lowermost horizontal support members define a second plane, wherein the third uppermost and lowermost horizontal support members define a third plane, and wherein the fourth uppermost and lowermost horizontal support members define a fourth plane; and d) wherein the first, second, third, and fourth outermost edges of the floor of the sheeting are spaced, respectively, from the first, second, third, and fourth planes.

15. The playyard of claim 1, and further comprising first, second, third, and fourth flexible flaps disposed, respectively, over the first, third, fifth, and seventh corner connections, the first flexible flap engaging inner and outer faces of the first and fourth sheeting portions, the second flexible flap engaging inner and outer faces of the first and second sheeting portions, the third flexible flap engaging inner and outer faces of the second and third sheeting portions, and the fourth flexible flap engaging inner and outer faces of the third and fourth sheeting portions.

16. The playyard of claim 1, wherein:

a) the first uppermost horizontal support member being engagable to and disengagable from the first and third corner connections;

b) the first lowermost horizontal support member being engagable to and disengagable from the second and fourth corner connections;

c) the second uppermost horizontal support member being engagable to and disengagable from the third and fifth corner connections;

d) the second lowermost horizontal support member being engagable to and disengagable from the fourth and sixth corner connections;

e) the third uppermost horizontal support member being engagable to and disengagable from the fifth and seventh corner connections;

f) the third lowermost horizontal support member being engagable to and disengagable from the sixth and eighth corner connections;

g) the fourth uppermost horizontal support member being engagable to and disengagable from the seventh and first corner connections;

h) the fourth lowermost horizontal support member being engagable to and disengagable from the eighth and second corner connections;

i) the first corner post being engagable to and disengagable from first and second corner connections;

j) the second corner post being engagable to and disengagable from the third and fourth corner connections;

k) the third corner post being engagable to and disengagable from fifth and sixth corner connections;

l) the fourth corner post being engagable to and disengagable from the seventh and eighth corner connections; and m) the first and second horizontal pieces being engagable to and disengagable from each other;

n) such that the frame of the playyard may be set up and broken down without destroying a structural integrity of any of the support members, corner connections, corner posts, and horizontal pieces of the frame.

17. The playyard of claim 12, wherein the first sheeting portion includes a mesh portion, wherein the second sheeting portion includes a mesh portion, wherein the third sheeting portion includes a mesh portion, and wherein the fourth sheeting portion includes a mesh portion.

18. The playyard of claim 12, wherein the first sheeting portion includes a mesh portion adjacent to upper and lower opaque bands, wherein the second sheeting portion includes a mesh portion adjacent to upper and lower opaque bands, wherein the third sheeting portion includes a mesh portion adjacent to upper and lower opaque bands, and wherein the fourth sheeting portion includes a mesh portion adjacent to upper and lower opaque bands.

* * * * *